US008820280B2

(12) United States Patent
Smith

(10) Patent No.: US 8,820,280 B2
(45) Date of Patent: Sep. 2, 2014

(54) VARIABLE CAMSHAFT TIMING MECHANISM WITH A DEFAULT MODE

(75) Inventor: Franklin R. Smith, Cortland, NY (US)

(73) Assignee: BorgWarner Inc., Auburn Hill, MI (US)

( * ) Notice: Subject to any disclaimer, the term of this patent is extended or adjusted under 35 U.S.C. 154(b) by 23 days.

(21) Appl. No.: 13/876,217

(22) PCT Filed: Sep. 30, 2011

(86) PCT No.: PCT/US2011/054196

§ 371 (c)(1),
(2), (4) Date: Mar. 27, 2013

(87) PCT Pub. No.: WO2012/047748

PCT Pub. Date: Apr. 12, 2012

(65) Prior Publication Data

US 2013/0180486 A1 Jul. 18, 2013

Related U.S. Application Data

(60) Provisional application No. 61/389,451, filed on Oct. 4, 2010, provisional application No. 61/417,943, filed on Nov. 30, 2010.

(51) Int. Cl.

| | |
|---|---|
| ***F01L 1/34*** | (2006.01) |
| ***F01M 9/10*** | (2006.01) |
| ***F01L 1/344*** | (2006.01) |
| ***F01L 1/047*** | (2006.01) |

(52) U.S. Cl.

CPC *F01L 1/047* (2013.01); *F01M 9/10* (2013.01); *F01L 1/3442* (2013.01)

USPC ..... 123/90.15; 123/90.17; 464/160

(58) Field of Classification Search

USPC ..... 123/90.15, 90.17; 464/160

See application file for complete search history.

(56) References Cited

U.S. PATENT DOCUMENTS

| | | | | |
|---|---|---|---|---|
| 5,738,056 | A | 4/1998 | Mikame et al. | |
| 6,170,448 | B1 | 1/2001 | Asakura | |
| 6,453,859 | B1 | 9/2002 | Smith et al. | |
| 6,666,181 | B2 | 12/2003 | Smith et al. | |
| 6,779,499 | B2 | 8/2004 | Takenaka et al. | |
| 6,814,038 | B2 | 11/2004 | Smith | |
| 6,941,913 | B2 | 9/2005 | Smith | |
| 7,137,371 | B2 | 11/2006 | Simpson et al. | |
| 7,513,230 | B2 * | 4/2009 | Knecht et al. | 123/90.17 |

FOREIGN PATENT DOCUMENTS

| | | | |
|---|---|---|---|
| JP | 2007138744 | A | 6/2007 |
| WO | 2009114500 | A | 9/2009 |

OTHER PUBLICATIONS

International Search Report for PCT/US2011/054196; Mailed May 7, 2012; 9 pages.

* cited by examiner

*Primary Examiner* — Ching Chang
(74) *Attorney, Agent, or Firm* — Brown & Michaels, PC

(57) ABSTRACT

A variable cam timing phaser with a control valve for directing fluid from a fluid input to and from the advance chamber and the retard chamber of the phaser through an advance line, a retard line, a common line, an advance default line, a retard default line, and at least one exhaust line. The control valve being movable between a default mode and an oil pressure actuated mode. In the default mode, the control valve blocks exhaust lines, retaining fluid within the chambers. The oil pressure actuated mode includes at least an advance mode, a retard mode, and a holding position.

22 Claims, 18 Drawing Sheets

VARIABLE CAMSHAFT TIMING MECHANISM WITH A DEFAULT MODE

REFERENCE TO RELATED APPLICATIONS

This application claims one or more inventions which were disclosed in Provisional Application No. 61/389,451, filed Oct. 4, 2010, entitled "VARIABLE CAMSHAFT TIMING MECHANISM WITH A DEFAULT MODE" and Provisional Application No. 61/417,943, filed Nov. 30, 2010, entitled "VARIABLE CAMSHAFT TIMING MECHANISM WITH A DEFAULT MODE". The benefit under 35 USC §119(e) of the United States provisional applications are hereby claimed, and the aforementioned application is hereby incorporated herein by reference.

BACKGROUND OF THE INVENTION

1. Field of the Invention

The invention pertains to the field of variable camshaft timing mechanisms. More particularly, the invention pertains to a hydraulic variable camshaft timing mechanism with a default mode.

2. Description of Related Art

Internal combustion engines have employed various mechanisms to vary the relative timing between the camshaft and the crankshaft for improved engine performance or reduced emissions. The majority of these variable camshaft timing (VCT) mechanisms use one or more "vane phasers" on the engine camshaft (or camshafts, in a multiple-camshaft engine). As shown in the figures, vane phasers have a rotor 105 with one or more vanes 104, mounted to the end of the camshaft 126, surrounded by a housing assembly 100 with the vane chambers into which the vanes fit. It is possible to have the vanes 104 mounted to the housing assembly 100, and the chambers in the rotor assembly 105, as well. The housing's outer circumference 101 forms the sprocket, pulley or gear accepting drive force through a chain, belt, or gears, usually from the crankshaft, or possible from another camshaft in a multiple-cam engine.

Apart from the camshaft torque actuated (CTA) variable camshaft timing (VCT) systems, the majority of hydraulic VCT systems operate under two principles, oil pressure actuation (OPA) or torsional assist (TA). In the oil pressure actuated VCT systems, an oil control valve (OCV) directs engine oil pressure to one working chamber in the VCT phaser while simultaneously venting the opposing working chamber defined by the housing, the rotor, and the vane. This creates a pressure differential across one or more of the vanes to hydraulically push the VCT phaser in one direction or the other. Neutralizing or moving the valve to a null position puts equal pressure on opposite sides of the vane and holds the phaser in any intermediate position. If the phaser is moving in a direction such that valves will open or close sooner, the phaser is said to be advancing and if the phaser is moving in a direction such that valves will open or close later, the phaser is said to be retarding.

The torsional assist (TA) systems operates under a similar principle with the exception that it has one or more check valves to prevent the VCT phaser from moving in a direction opposite than being commanded, should it incur an opposing force such as torque.

The problem with OPA or TA systems is that the oil control valve defaults to a position that exhausts all the oil from either the advance or retard working chambers and fills the opposing chamber. In this mode, the phaser defaults to moving in one direction to an extreme stop where the lock pin engages. The OPA or TA systems are unable to direct the VCT phaser to any other position during the engine start cycle when the engine is not developing any oil pressure. This limits the phaser to being able to move in one direction only in the default mode. In the past this was acceptable because at engine shut down and during engine start the VCT phaser would be commanded to lock at one of the extreme travel limits (either full advance or full retard). However, recent calibration work has demonstrated that there is considerable benefit to start the engine with the VCT system in some intermediate position and not at the extreme stops.

In addition with large range of angular motion on a VCT phaser it is necessary to start in the mid travel position because the extreme stops may be positions where the engine will not start or be damaged during an engine start. It is equally desirable that if the engine is shut down and the phaser is not in the optimum mid start position that the phaser is able to move in either direction during engine cranking to get back to the optimum start position somewhere in mid travel. Current OPA and TA VCT systems are not capable of such recovery because by default they exhaust the oil from one of the working chambers (either advance or retard) and therefore render that chamber a non working chamber at shut down, such that the VCT phaser can only move in one direction.

SUMMARY OF THE INVENTION

A variable cam timing phaser for an internal combustion engine including a housing assembly, a rotor, and a control valve. The housing assembly has an outer circumference for accepting drive force and the rotor assembly is coaxially located within the housing for connection to a camshaft. The rotor has a plurality of vanes, with one vane separating a chamber formed between the housing and the rotor into an advance chamber and a retard chamber. The control valve directs fluid from a fluid input to and from the advance chamber and the retard chamber through an advance line, a retard line, a common line, and at least one exhaust line. The control valve is movable between a default mode and an oil pressure actuated mode. The oil pressure actuated mode at least includes the control valve being movable to an advance mode in which fluid is routed from the fluid input to the advance chamber and fluid is also routed from the retard chamber to at least one exhaust line, a retard mode in which fluid is routed from the fluid input to the retard chamber and fluid is also routed from the advance chamber to at least one exhaust line, and a holding position in which fluid is routed to both of the chambers. In the default mode, the control valve blocks the at least one exhaust line, retaining fluid within the advance chamber and retard chamber.

DETAILED DESCRIPTION OF THE INVENTION

Figure 1:
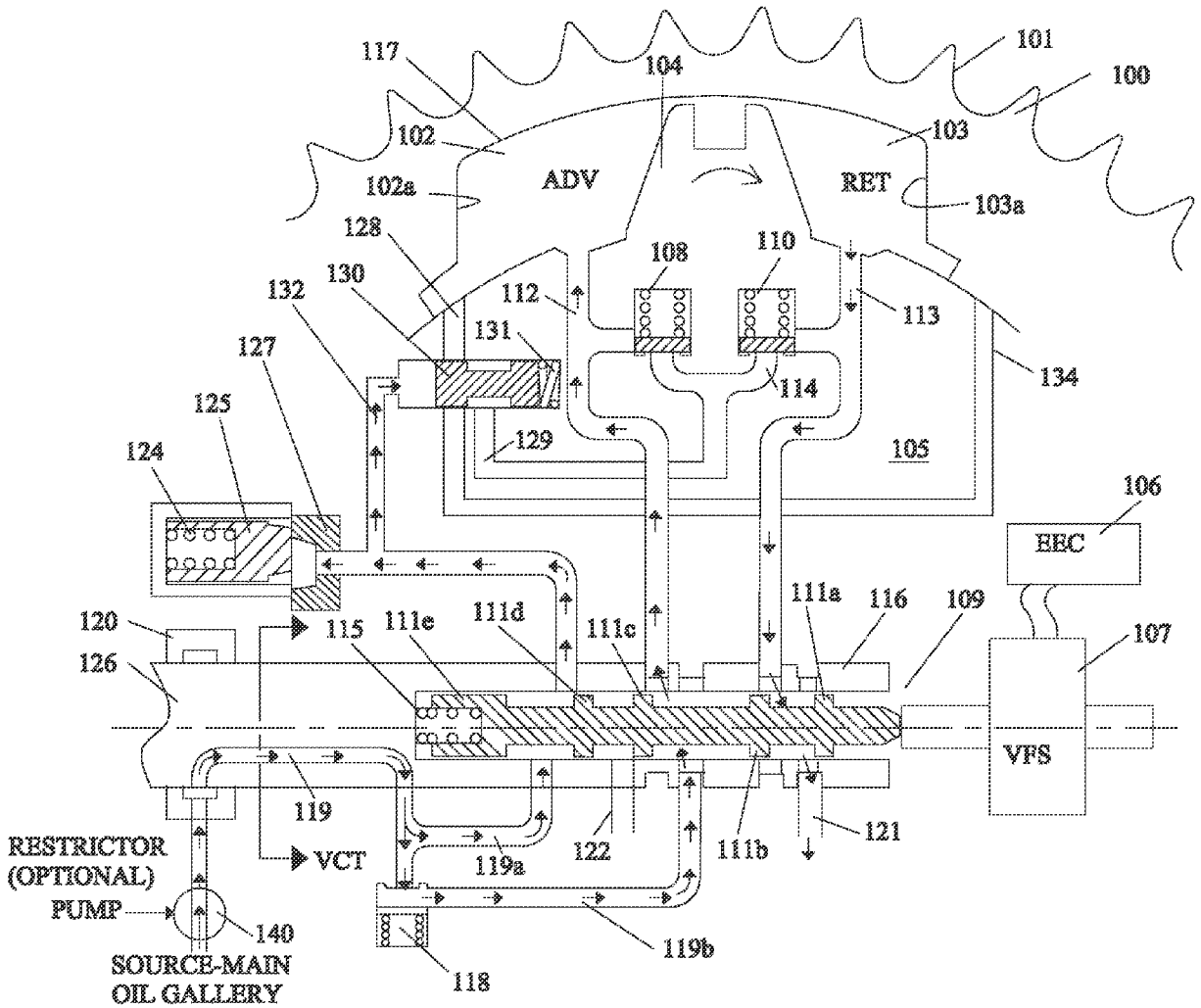
FIG. 1 shows a schematic of a first embodiment of a torsion assist (TA) phaser of the present invention moving towards an advance position

The present invention overcomes the limitations of the torsion assist (TA) and oil pressure actuated (OPA) variable camshaft timing (VCT) systems such that as desired, TA or OPA VCT phasers can have one or more working chambers operate in a cam torque actuated (CTA) operating mode. The invention utilizes the control valve in a default mode and a hydraulic default circuit to direct the VCT phaser in either direction, advance or retard, to reach the mid lock position and, if so desired, to engage a locking pin at that mid lock position. The following description and embodiments are described in terms of a torsion assisted (TA) phaser, which has one or more check valves in oil supply lines, but it will be understood that they are also applicable to an oil pressure actuated phaser.

In the present invention, an offset or remote piloted valve is added to a hydraulic circuit of a torsion assist or oil pressure actuated phaser to manage the hydraulic default switching function.

The piloted valve may be controlled with the same hydraulic circuit that engages or releases the lock pin. This shortens the VCT control valve back to two hydraulic circuits (versus three as discussed in the background section), a VCT control circuit and a combined lock pin/hydraulic default control circuit. Movement of the piloted valve to the first position is actively controlled by the remote on/off valve or the control valve of the phaser.

One of the advantages to using the remote piloted valve is that it can have a longer stroke than the control valve, since it is not limited by a solenoid. Therefore, the piloted valve can open up a larger flow passage for the hydraulic default mode and improve actuation rate in the default mode. In addition, the location of the remote piloted valve shortens and simplifies the hydraulic default circuit and thereby increases performance of the VCT default mode or intermediate phase angle position of the phaser.

FIGS. 1-18 show the operating modes the VCT phaser depending on the spool valve position. The positions shown in the figures define the direction the VCT phaser is moving to. It is understood that the phase control valve has an infinite number of intermediate positions, so that the control valve not only controls the direction the VCT phaser moves but, depending on the discrete spool position, controls the rate at which the VCT phaser changes positions. Therefore, it is understood that the phase control valve can also operate in infinite intermediate positions and is not limited to the positions shown in the Figures.

Referring to FIGS. 1-6 of the first embodiment, the housing assembly 100 of the phaser has an outer circumference 101 for accepting drive force. The rotor assembly 105 is connected to the camshaft 126 and is coaxially located within the housing assembly 100. The rotor assembly 105 has a vane 104 separating a chamber 117 formed between the housing assembly 100 and the rotor assembly 105 into an advance chamber 102 and a retard chamber 103. The vane 104 is capable of rotation to shift the relative angular position of the housing assembly 100 and the rotor assembly 105. Additionally, a hydraulic default circuit 133 and a lock pin circuit 123 are also present. The hydraulic default circuit 133 and the lock pin circuit 123 are essentially one circuit as discussed above, but will be discussed separately for simplicity.

The hydraulic default circuit 133 includes a spring 131 loaded piloted valve 130 and an advance default line 128 that connects the advance chamber 102 to the piloted valve 130 and the common line 114 to check valves 108, 110, and a retard default line 134 that connects the retard chamber 103 to the piloted valve 130 and the common line 114 to check valves 108, 110. The advance default line 128 and the retard default line 134 are a predetermined distance or length from the vane 104. The piloted valve 130 is in the rotor assembly 105 and is fluidly connected to the lock pin circuit 123 and line 119*a* through line 132. The lock pin circuit 123 includes the lock pin 125, lock pin spring 124, line 132, the piloted valve 130, supply line 119*a*, and exhaust line 122.

The lock pin 125 is slidably housed in a bore in the rotor assembly 105 and has an end portion that is biased towards and fits into a recess 127 in the housing assembly 100 by a spring 124. Alternatively, the lock pin 125 may be housed in the housing assembly 100 and be spring 124 biased towards a recess 127 in the rotor assembly 105. The opening and closing of the hydraulic default circuit 133 and pressurization of the lock pin circuit 123 are both controlled by the switching/movement of the phase control valve 109.

A control valve 109, preferably a spool valve, includes a spool 111 with cylindrical lands 111*a*, 111*b*, 111*c*, 111*d*, and 111*e* slidably received in a sleeve 116 within a bore in the rotor 105 and pilots in the camshaft 126. One end of the spool contacts spring 115 and the opposite end of the spool contacts a pulse width modulated variable force solenoid (VFS) 107. The solenoid 107 may also be linearly controlled by varying current or voltage or other methods as applicable. Additionally, the opposite end of the spool 111 may contact and be influenced by a motor, or other actuators.

The position of the spool 111 is influenced by spring 115 and the solenoid 107 controlled by the ECU 106. Further detail regarding control of the phaser is discussed in detail below. The position of the spool 111 controls the motion (e.g. to move towards the advance position, holding position, or the retard position) of the phaser as well as whether the lock pin circuit 123 and the hydraulic default circuit 133 are open (on) or closed (off). In other words, the position of the spool 111 actively controls the piloted valve. The control valve 109 has an advance mode, a retard mode, a holding position, and a default mode.

In the advance mode, the spool 111 is moved to a position so that fluid may flow from supply S by pump 140 through inlet check valve 118, through line 119*b* to the advance chamber 102 and fluid from the retard chamber 103 exits through the spool 111 to exhaust line 121. The default valve circuit 133 is off or closed and the lock pin 125 is preferably unlocked.

In the retard mode, the spool 111 is moved to a position so that fluid may flow from supply S by pump 140 through inlet check valve 118, through line 119*b* to the retard chamber 103 and fluid from the advance chamber 102 exits through the spool 111 to exhaust line 122. The default valve circuit 133 is off and the lock pin 125 is preferably unlocked.

In holding position or null mode, the spool 111 is moved to a position that is partially open to the advance chamber 102 and the retard chamber 103 and allows supply fluid to bleed into the advance and retard chambers 102, 103, applying the same pressure to the advance chamber and retard chamber to hold the vane position. The default valve circuit 133 is off and the lock pin 125 is preferably unlocked.

In the default mode, three functions occur simultaneously:

The first function in the default mode is that the spool 111 moves to a position in which spool lands 111*d* and 111*b* blocks the flow of fluid from line 112 and line 113 from exiting the chambers 102, 103 through exhaust lines 121, 122, and only allowing a small amount of pressurized fluid from supply S to enter the advance chamber 102 and the retard chamber 103 to keep the advance and retard chambers 102, 103 full, effectively removing control of the phaser from the control valve 109.

The second function in default mode is to open or turn on the default valve circuit 133. With the default valve is open, one or more of the torsion assist advance and retard chambers 102, 103 are converted to cam torque actuated (CTA) mode. In other words, fluid is allowed to recirculate between the advance chamber and the retard chamber, instead of supply filling one chamber and exhausting the opposite chamber to sump through exhaust lines. The default valve circuit 133 has complete control over the phaser moving to advance or retard, until the vane 104 reaches the intermediate phase angle position.

The third function in the default mode is to vent the lock pin circuit 123, allowing the lock pin 125 to engage the recess 127. The intermediate phase angle position or mid position is when the vane 104 is somewhere between the advance wall 102*a* and the retard wall 103*a* defining the chamber between the housing assembly 100 and the rotor assembly 105. The intermediate phase angle position can be anywhere between the advance wall 102*a* and retard wall 103*a* and is determined by where the default passages 128 and 134 are relative to the vane 104.

Based on the duty cycle of the pulse width modulated variable force solenoid 107, the spool 111 moves to a corresponding position along its stroke. When the duty cycle of the variable force solenoid 107 is approximately 30%, 50% or 100%, the spool 111 will be moved to positions that correspond with the retard mode, the holding position, and the advance mode, respectively and the piloted valve 130 will be pressurized and move to the second position, the hydraulic default circuit 133 will be closed, and the lock pin 125 will be pressurized and released. When the duty cycle of the variable force solenoid 107 is 0%, the spool 111 is moved to the default mode such that the piloted valve 130 vents and moves to the second position, the hydraulic default circuit 133 will be open, and the lock pin 125 vented and engaged with the recess 127. A duty cycle of 0% was chosen as the extreme position along the spool stroke to open the hydraulic default circuit 133, vent the piloted valve 130, and vent and engage the lock pin 125 with the recess 127, since if power or control is lost, the phaser will default to a locked position. It should be noted that the duty cycle percentages listed above are an example and they may be altered. Furthermore, the hydraulic default circuit 133 may be open, the piloted valve 130 vented, and the lock pin 125 vented and engaged with the recess 127 at 100% duty cycle, if desired.

It should be noted that the duty cycle of the variable force solenoid 107 of approximately 30%, 50%, or 100% may alternatively correspond to the spool 111 being moved to positions that correspond to the advance mode, the holding position, and the retard mode, respectively.

FIG. 1 shows the phaser moving towards the advance position. To move towards the advance position, the duty cycle is increased to greater than 50% and up to 100%, the force of the VFS 107 on the spool 111 is increased and the spool 111 is moved to the left by the VFS 107 in an advance mode, until the force of the spring 115 balances the force of the VFS 107. In the advance mode shown, spool land 111*c* blocks exhaust line 122 and spool land 111*b* prevents recirculation of fluid between the advance chamber 102 and the retard chamber 103. Line 112 is open to supply S from line 119*b* and line 113 is open to exhaust line 121 to exhaust any fluid from the retard chamber 103. Hydraulic fluid is supplied to the phaser from supply S by pump 140 and enters line 119 through a cam interface 120. Line 119 splits into two lines 119*a* and 119*b*. Line 119*b* leads to an inlet check valve 118 and the control valve 109. From the control valve 109, fluid enters line 112 and the advance chamber 102, moving the vane 104 in the direction shown by the arrow, and causing fluid to move from the retard chamber 103 and exit into line 113 to the control valve 109 and exhaust to sump through exhaust line 121.

Line 119*a* leads to the lock pin 125 and branches into line 132 which leads to the piloted valve 130. The pressure of the fluid in line 119*a* moves through the spool 111 between lands 111*d* and 111*e* to bias the lock pin 125 against the spring 124 to a released position, filling the lock pin circuit 123 with fluid. The fluid in line 119*a* also flows through line 132 and pressurizes the piloted valve 130 against the spring 131, moving the piloted valve 130 to a position where retard default line 134, advance default line 128 and line 129 are blocked as shown in FIGS. 1 and the default circuit is off. Exhaust line 122 is blocked by spool land 111*d*, preventing the lock pin 125 from venting.

Figure 2:
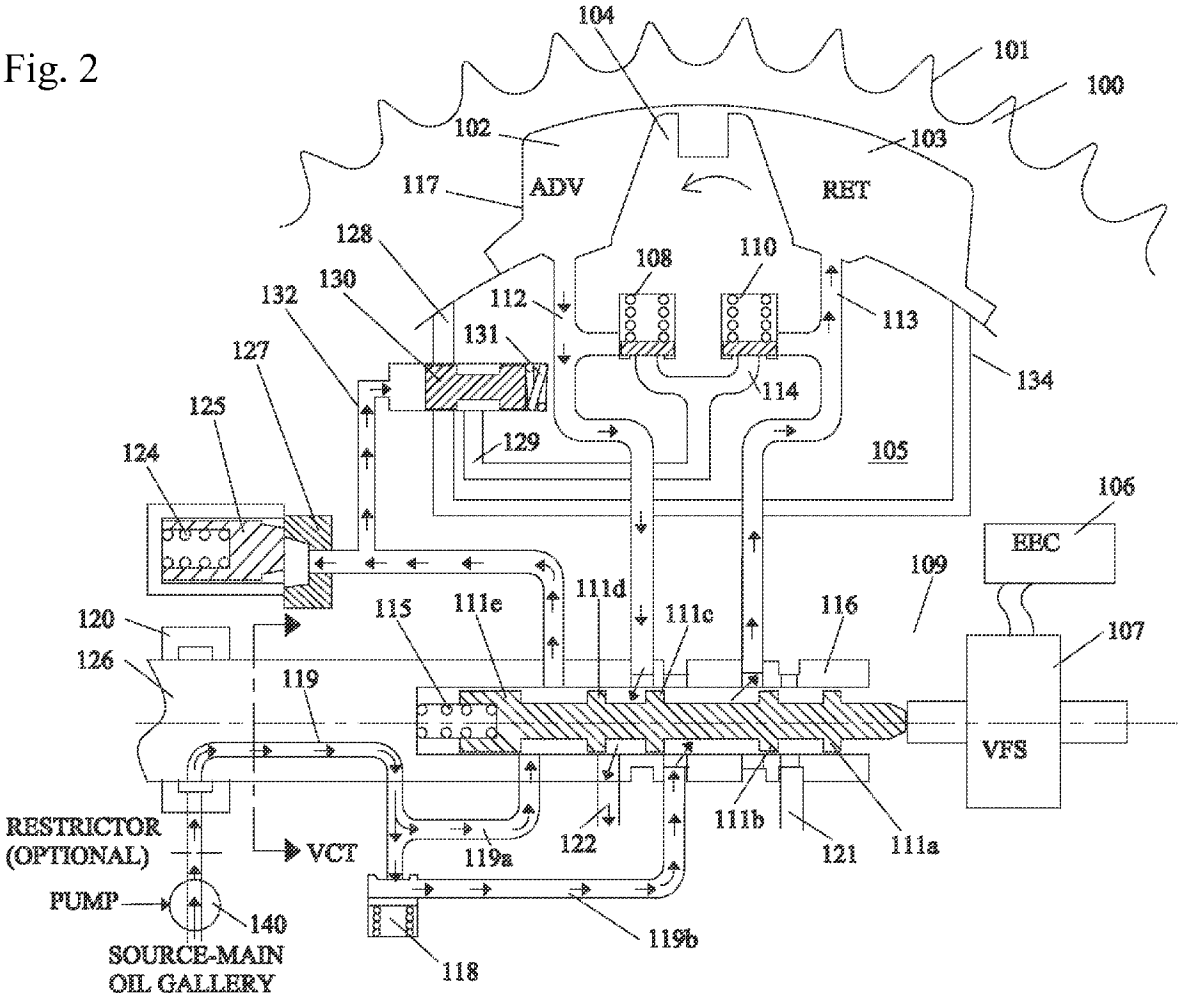
FIG. 2 shows a schematic of a first embodiment of a torsion assist (TA) phaser of the present invention moving towards a retard position.

FIG. 2 shows the phaser moving towards the retard position. To move towards the retard position, the duty cycle is adjusted to a range greater than 30% but less than 50%, the force of the VFS 107 on the spool 111 is changed and the spool 111 is moved to the right in a retard mode in the figure by spring 115, until the force of spring 115 balances the force of the VFS 107. In the retard mode shown, spool land 111*b* blocks exhaust line 121 and spool land 111*c* prevents recirculation of fluid between the advance chamber 102 and the retard chamber 103. Lines 113 is open to supply S from line 119*b* and line 112 is open to exhaust line 122 to exhaust any fluid from the advance chamber 102. Hydraulic fluid is supplied to the phaser from supply S by pump 140 and enters line 119 through a cam interface 120. Line 119 splits into two lines 119*a* and 119*b*. Line 119*b* leads to an inlet check valve 118 and the control valve 109. From the control valve 109, fluid enters line 113 and the retard chamber 103, moving the vane 104 in the direction shown by the arrow, and causing fluid to move from the advance chamber 102 and exit into line 112 to the control valve 109 and exhaust to sump through exhaust line 122.

Line 119*a* leads to the lock pin 125 and branches into line 132 which leads to the piloted valve 130. The pressure of the fluid in line 119*a* moves through the spool 111 between lands 111*d* and 111*e* to bias the lock pin 125 against the spring 124 to a released position, filling the lock pin circuit 123 with fluid. The fluid in line 119*a* also flows through line 132 and pressurizes the piloted valve 130 against the spring 131, moving the piloted valve 130 to a position where retard default line 134 and the advance default line 128 are blocked from line 129 and from each other as shown in FIG. 2 and the default circuit is off. Exhaust line 122 is blocked by spool land 111*d*, preventing the lock pin 125 and the piloted valve 130 from venting.

Figure 3:
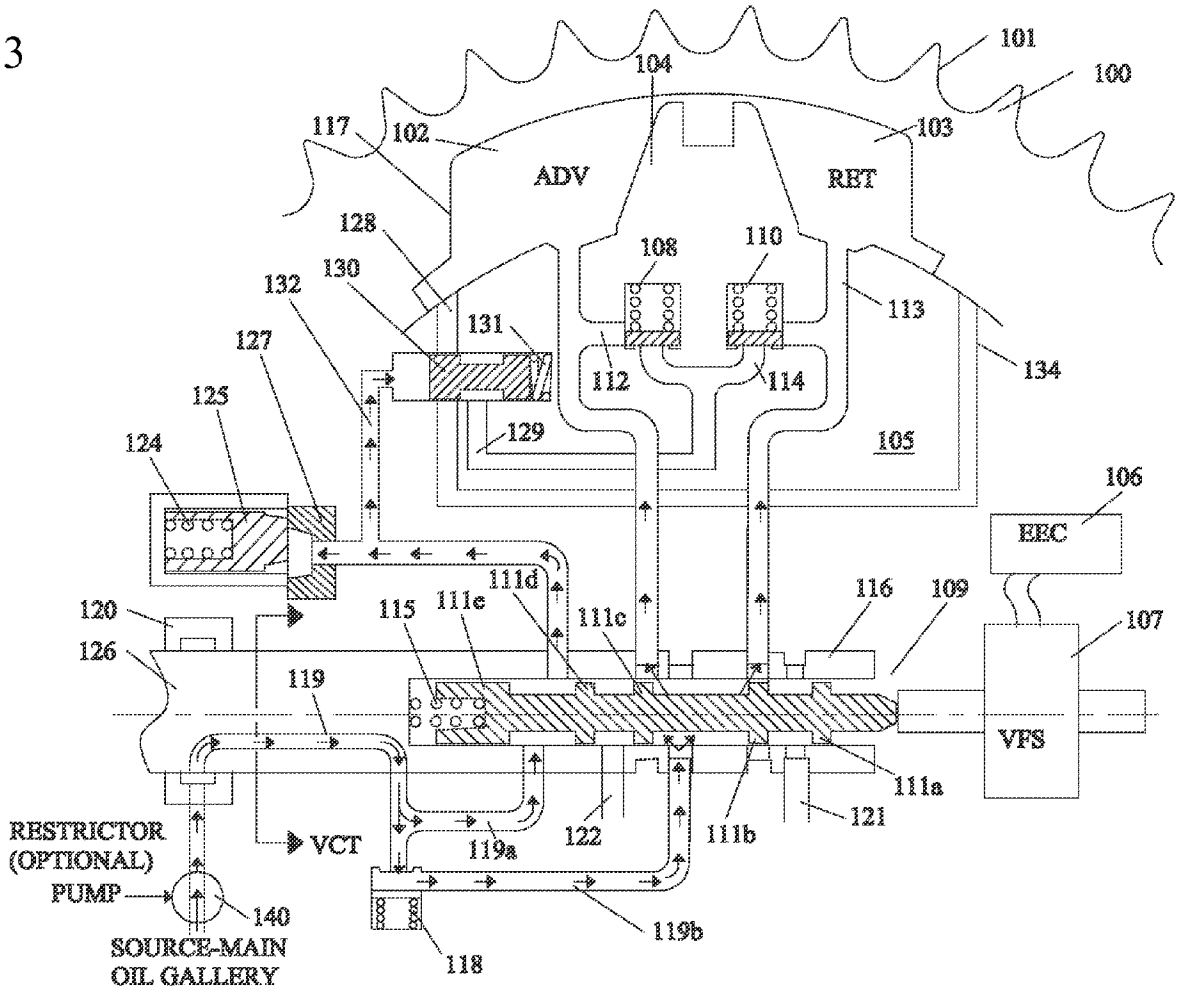
FIG. 3 shows a schematic of a first embodiment of a torsion assist (TA) phaser of the present invention in a holding position.

FIG. 3 shows the phaser in the holding position. In this position, the duty cycle of the variable force solenoid 107 is 50% and the force of the VFS 107 on one end of the spool 111 equals the force of the spring 115 on the opposite end of the spool 111 in holding mode. The lands 111*b* and 111*c* allow fluid from supply S to bleed into the advance chamber 102 and the retard chamber 103. Exhaust line 121 is blocked from exhausting fluid from line 113 by spool land 111*b* and exhaust line 122 is blocked from exhausting fluid from line 112 by spool land 111*c*. Line 119 splits into two lines 119*a* and 119*b*. Line 119*b* leads to inlet check valve 118 and the control valve 109. From the control valve 109, fluid enters lines 112 and 113 and enters the advance chamber 102 and the retard chamber 103. Line 119*a* leads to the lock pin 125 and branches into line 132 which leads to the piloted valve 130. The pressure of the fluid in line 119*a* moves through the spool 111 between lands 111*d* and 111*e* to bias the lock pin 125 against the spring 124 to a released position, filling the lock pin circuit 123. The fluid in line 119*a* also flows through line 132 and pressurizes the piloted valve 130 against the spring 131, moving the piloted valve 130 to a position where retard default line 134 and advance default line 128 are blocked from line 129 and from each other as shown in FIG. 3 and the default circuit 133 is off. Exhaust line 122 is blocked by spool land 111*d*, preventing the lock pin 125 and piloted valve 130 from venting.

Figure 4:
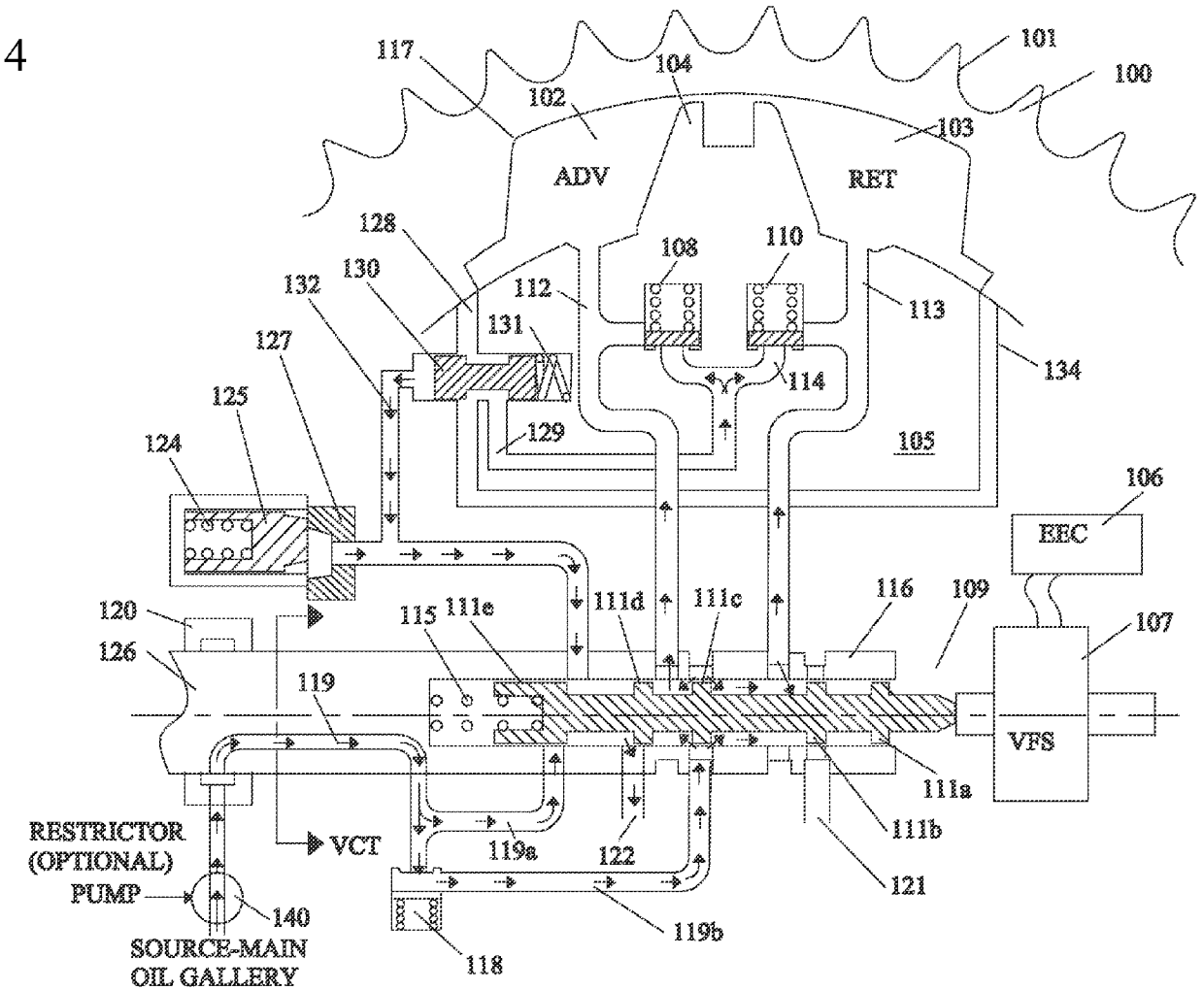
FIG. 4 shows a schematic of a first embodiment of a torsion assist (TA) phaser of the present invention with a hydraulic default circuit in an open position and the phaser in a locked position.
Figure 5:
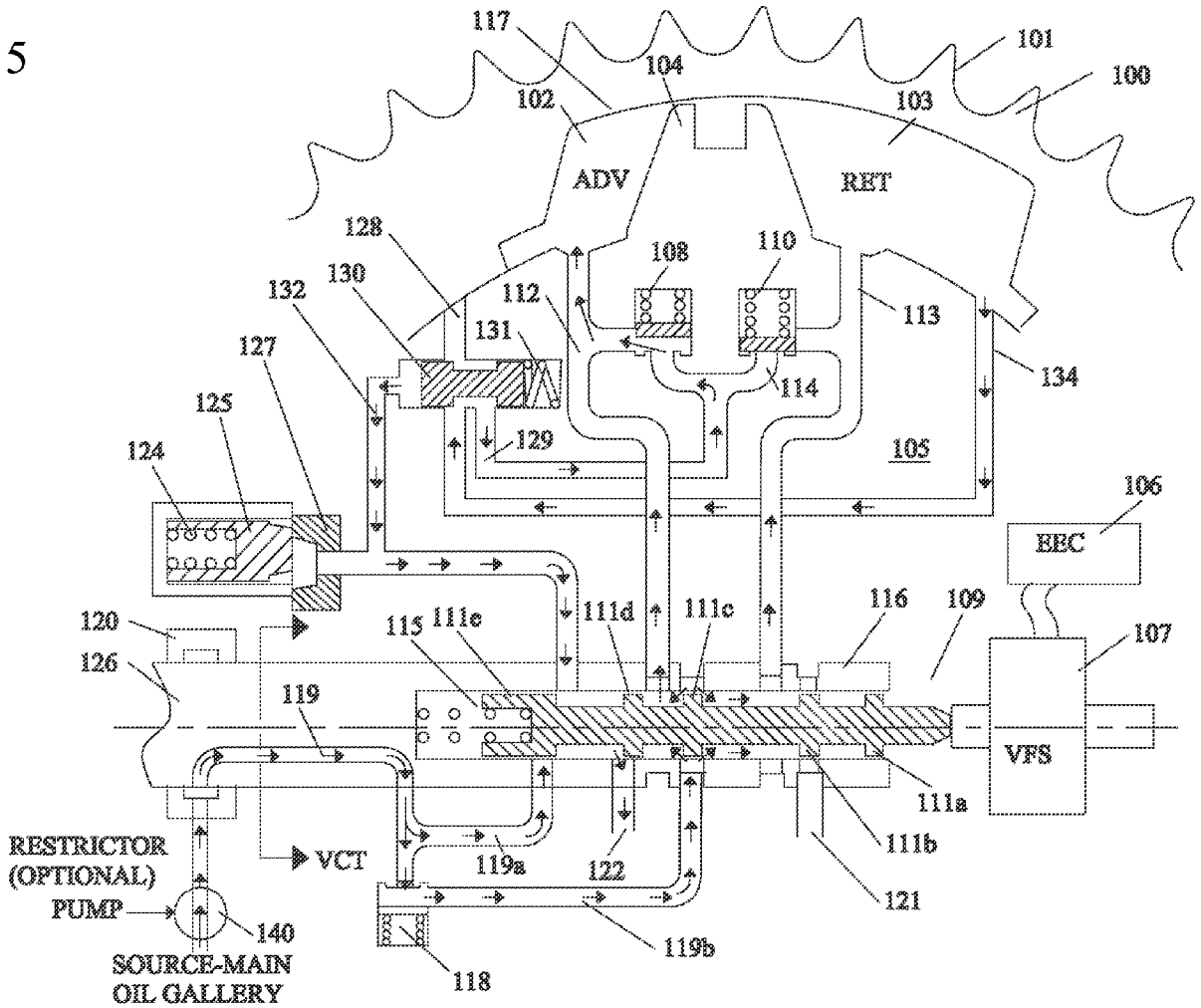
FIG. 5 shows a schematic of a first embodiment of a torsion assist (TA) phaser of the present invention with a hydraulic default circuit in an open position and the phaser moving via the default circuit in the advance direction towards a locked position.
Figure 6:
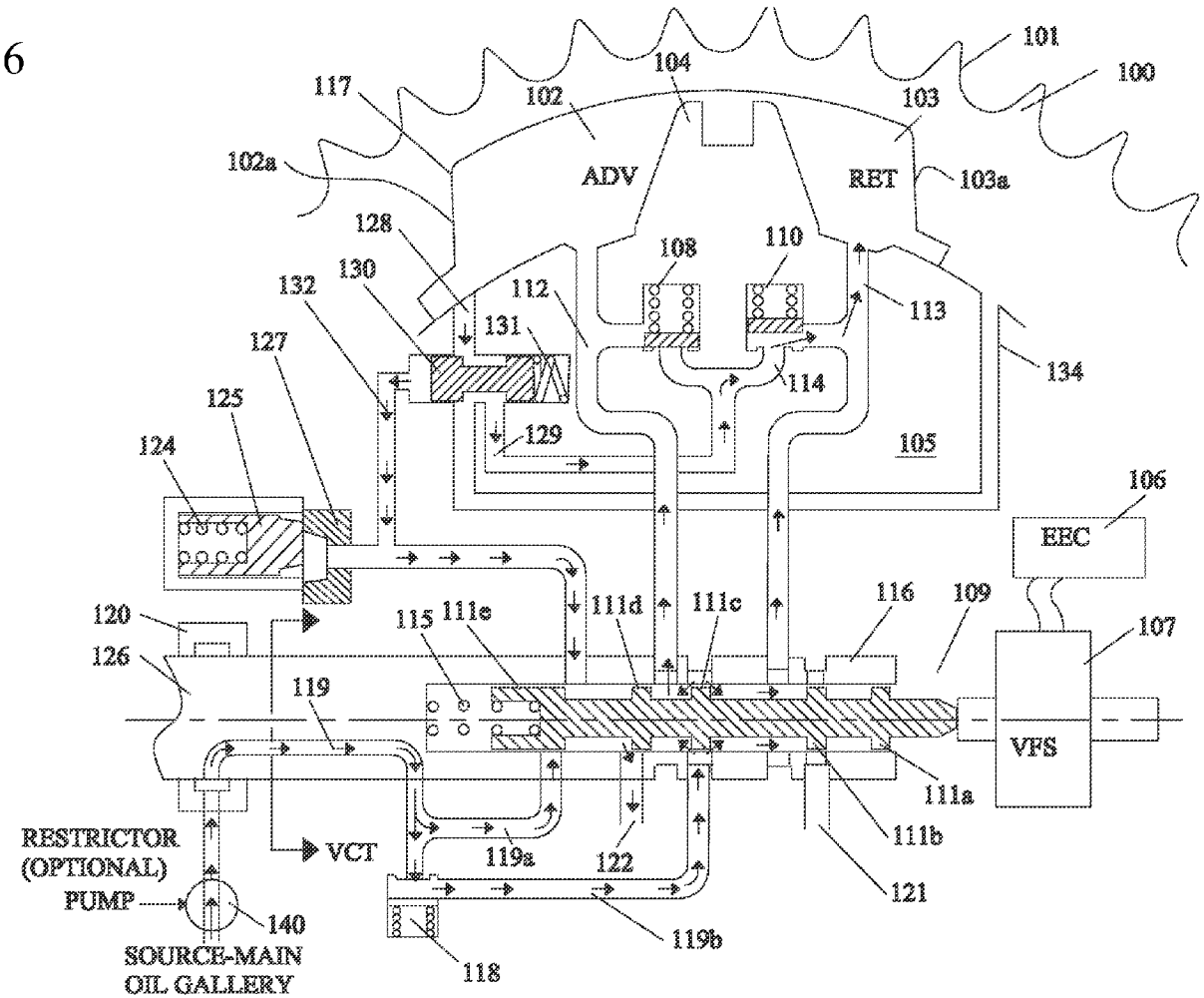
FIG. 6 shows a schematic of a first embodiment of a torsion assist (TA) phaser of the present invention with a hydraulic default circuit in an open position and the phaser moving via the default circuit in the retard direction towards a locked position.

Referring to FIGS. 4-6, when the duty cycle of the variable force solenoid 107 is 0%, the spool is in default mode, the piloted valve 130 is vented, the hydraulic default circuit 133 is open or on, and the lock pin circuit 123 is off or closed, the lock pin 125 is vented and engages with a recess 127, and the rotor 105 is locked relative to the housing assembly 100 in a mid position or an intermediate phase angle position. Depending on where the vane 104 was prior to the duty cycle of the variable force solenoid 107 being changed to 0%, either the advance default line 128 or the retard default line 134 will be exposed to the advance or retard chamber 102, 103 respectively. In addition, if the engine had an abnormal shut down (e.g. the engine stalled), when the engine is cranking, the duty cycle of the variable force solenoid 107 would be 0%, the rotor assembly 105 would move via the default circuit 133 to a mid lock position or an intermediate phase angle position and the lock pin 125 would be engaged in mid position or intermediate phase angle position regardless of what position the vane 104 was in relative to the housing assembly 100 prior to the abnormal shut down of the engine. In the present invention, default mode is preferably when the spool is an extreme end of travel. In the examples shown in the present invention, it is when the spool is at an extreme full out position from the bore.

The ability of the phaser of the present invention to default to a mid position or intermediate phase angle position without using electronic controls allows the phaser to move to the mid position or intermediate phase angle position even during engine cranking when electronic controls are not typically used for controlling the cam phaser position. In addition, since the phaser defaults to the mid position or intermediate phase angle position, it provides a fail safe position, especially if control signals or power is lost, that guarantees that the engine will be able to start and run even without active control over the VCT phaser. Since the phaser has the mid position or intermediate phase angle position upon cranking of the engine, longer travel of the phase of the phaser is possible, providing calibration opportunities. In the prior art, longer travel phasers or a longer phase angle is not possible, since the mid position or intermediate phase angle position is not present upon engine cranking and startup and the engine has difficulty starting at either the extreme advance or retard stops.

When the duty cycle of the variable force solenoid 107 is set to 0%, the force on the VFS on the spool 111 is decreased, and the spring 115 moves the spool 111 to the far right end of the spool's travel to a default position as shown in FIGS. 4-6. In this default position, spool land 111*b* blocks the flow of fluid from line 113 to exhaust port 121 and spool land 111*d* blocks the flow of fluid from line 112 to exhaust port 122, effectively removing control of the phaser from the control valve 109. At the same time, fluid from supply may flow through line 119 to line 119*b* and inlet check valve 118 to bleed past spool land 111*c* and flow into the advance chamber 102 and the retard chamber 103 through lines 112 and 113 respectively. Fluid is prevented from flowing through line 119*a* to the lock pin 125 by spool land 111*e*. Since fluid cannot flow to line 119*a*, the lock pin 125 is no longer pressurized and vents through the spool 111 between spool land 111*d* and spool land 111*e* to exhaust line 122. Similarly, the piloted valve 130 also vents to exhaust line 122, opening passage between the advance default line 128 and the retard default line 134 through the piloted valve 130 to line 129 and the common line 114, in other words opening the hydraulic default circuit 133 and essentially converting all of the torsion assist chambers into cam torque actuated chambers (CTA) or into CTA mode with circulation of fluid being allowed between the advance chamber 102 and the retard chamber 103.

Referring to FIG. 5, if the vane 104 was positioned within the housing assembly 100 near or in the advance position and the retard default line 134 is exposed to the retard chamber 103, then fluid from the retard chamber 103 will flow into the retard default line 134 and through the open piloted valve 130 and to line 129 leading to common line 114. From the common line 114, fluid flows through check valve 108 and into the advance chamber 102, moving the vane 104 relative to the housing assembly 100 to close off the retard default line 134 to the retard chamber 103. As the rotor 105 closes off line the retard default 134 from the retard chamber 103, the vane 104 is moved to an intermediate phase angle position or a mid position within the chamber formed between the housing assembly 100 and the rotor assembly 105, and the lock pin 125 aligns with the recess 127, locking the rotor 105 relative to the housing assembly 100 in a mid position or an intermediate phase angle position.

Referring to FIG. 6, if the vane 104 was positioned within the housing assembly 100 near or in the retard position and the advance default line 128 is exposed to the advance chamber 102, then fluid from the advance chamber 102 will flow into the advance default line 128 and through the open piloted valve 130 and to line 129 leading to common line 114. From the common line 114, fluid flows through check valve 110 and into the retard chamber 103, moving the vane 104 relative to the housing assembly 100 to close off or block advance default line 128 to the advance chamber 102. As the rotor assembly 105 closes off the advance default line 128 from the advance chamber 102, the vane 104 is moved to an intermediate phase angle position or a mid position within the chamber formed between the housing assembly 100 and the rotor assembly 105, and the lock pin 125 aligns with recess 127, locking the rotor assembly 105 relative to the housing assembly 100 in a mid position or an intermediate phase angle position.

The advance default line 128 and the retard default line 134 are completely closed off or blocked by the rotor assembly 105 from the advance and retard chambers 102, 103 when phaser is in the mid position or intermediate phase angle position, requiring that the lock pin 125 engages the recess 127 at the precise time in which the advance default line 128 or the retard default line 134 are closed off from their respective chambers. Alternatively, the advance default line 128 and the retard default line 134 may be slightly open or partially restricted to the advance and retard chambers 102, 103, in the mid position or intermediate phase angle position to allow the rotor assembly 105 to oscillate slightly, increasing the likelihood the lock pin 125 will pass over the position of the recess 127 so the lock pin 125 can engage the recess 127.

Figure 14:
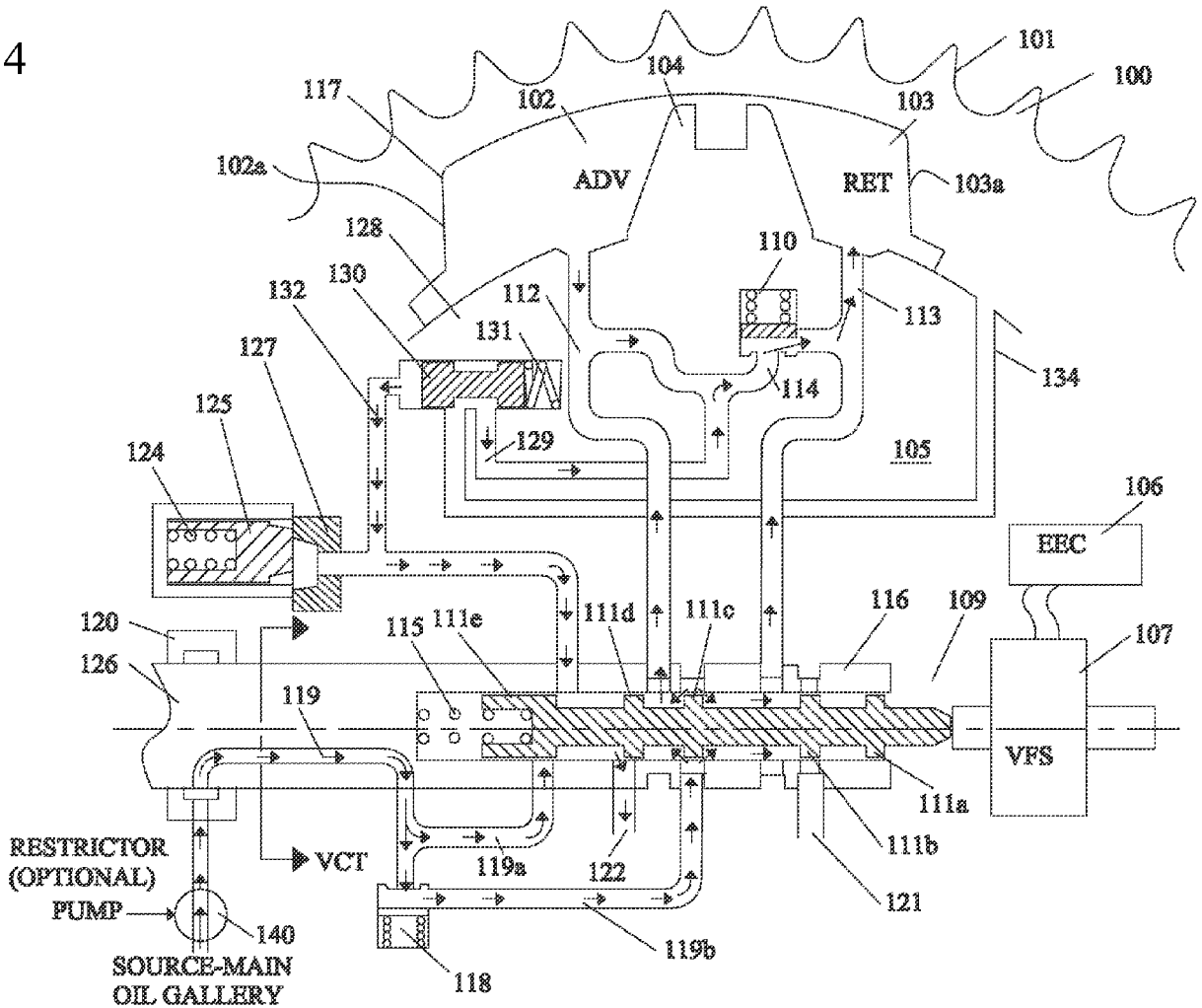
FIG. 14 shows a schematic of an alternative of the first embodiment of a torsion assist (TA) phaser of the present invention with a hydraulic default circuit for the retard chamber only.

Referring to FIG. 14, an alternative embodiment, the default circuit 433 is present for the retard chamber 103 only and assists in finding a mid position stop in one direction. The detent circuit 433 allows the phaser to oscillate between the mid position stop and one of the extreme stops, for example when the vane 104 is in contact with the advance wall 102*a* or the retard wall 103*a*.

The difference between the embodiment shown in FIG. 14 and the first embodiment of FIGS. 1-6 is the removal of the advance default line 128 and the check valve 108 between the common line 114, line 112 and the advance chamber 102. For this embodiment, identical reference numbers as in the preceding figures apply to the same description above and are repeated herein by reference.

The hydraulic default circuit 433 includes a spring 131 loaded piloted valve 130 connected to a retard default line 134 that connects the retard chamber 103 to the piloted valve 130 and the common line 114 to check valve 110. The retard default line 134 is a predetermined distance or length from the vane 104. The piloted valve 130 is in the rotor assembly 105 and is fluidly connected to the lock pin circuit 123 and line 119*a* through line 132. The lock pin circuit 123 includes the lock pin 125, lock pin spring 124, line 132, the piloted valve 130, supply line 119*a*, and exhaust line 122.

In the default mode, the spool 111 moves to a position in which spool lands 111*d* and 111*b* blocks the flow of fluid from line 112 and line 113 from exiting the chambers 102, 103 through exhaust lines 121, 122, and only allowing a small amount of pressurized fluid from supply S to enter the advance chamber 102 and the retard chamber 103 to keep the advance and retard chambers 102, 103 full, effectively removing control of the phaser from the control valve 109.

With the default valve circuit 433 on or open, and the default valve open, one or more of the torsion assist advance and retard chambers 102, 103 are converted to cam torque actuated (CTA) mode. In other words, fluid is allowed to recirculate between the advance chamber and the retard chamber, instead of supply filling one chamber and exhausting the opposite chamber to sump through exhaust lines. The default valve circuit 433 has complete control over the phaser moving to advance or retard, until the vane 104 reaches the intermediate phase angle position.

In the default mode the lock pin circuit 123 is vented, allowing the lock pin 125 to engage the recess 127. The intermediate phase angle position or mid position is when the vane 104 is somewhere between the advance wall 102*a* and the retard wall 103*a* defining the chamber between the housing assembly 100 and the rotor assembly 105. The intermediate phase angle position can be anywhere between the advance wall 102*a* and retard wall 103*a* and is determined by where the retard default passage 134 is relative to the vane 104.

Depending on where the vane 104 was prior to the duty cycle of the variable force solenoid 107 being changed to 0%, fluid from the advance chamber 102 will exit through line 112 and flows into common line 114, through check valve 110 to the retard chamber 103 through line 113. As the retard chamber 103 fills, the retard default line 134 is exposed and fluid in the retard chamber 103 recirculates back to the retard chamber 103 or advance chamber 102 depending on the direction of cam torque through the piloted valve 130. Therefore, in the retard direction, the phaser can freely move until the vane 104 contacts the advance wall 102*a*.

In the advance direction, when the hydraulic detent circuit is open, the phaser moves until the retard default line 134 is closed off by the housing 100. The retard default line 134 is closed off or blocked by the rotor assembly 105 from the retard chamber 103 when phaser is in the mid position or intermediate phase angle position, requiring that the lock pin 125 engages the recess 127 at the precise time in which the retard default line 134 is closed off from its respective chambers. If the lock pin 125 doesn't engage the recess 127, the rotor 105 and vane 104 oscillates between a detent position where the retard default line 134 is blocked by the housing 100 and full retard stop, (e.g. on the side with the shortest amount of travel between the mid position locking of the lock pin) where vane 104 contacts the advance wall 102*a*. When the phaser is oscillating, the lock pin 125 will eventually mate with the recess 127, locking the phaser in the mid position.

One of the advantages of only having a default line on one side of the phaser is decreased costs, since only one check valve is needed, not two and less drilling of the phaser is required.

It is preferable to have the check valve and default line on the side of the phaser with the longest travel for the lock pin to engage the recess and not have the check valve and default line with the shortest amount of travel for the lock pin to engage the recess, therefore limiting the amount of oscillation to the side, e.g. between the intermediate phase angle or mid position stop and the extreme stop and therefore the increased oscillation that does occur is on one end of the vane travel.

Alternatively, the check valve and default line on the opposite side, for example check valve 110 and default line 134 may also be removed.

Figure 7:
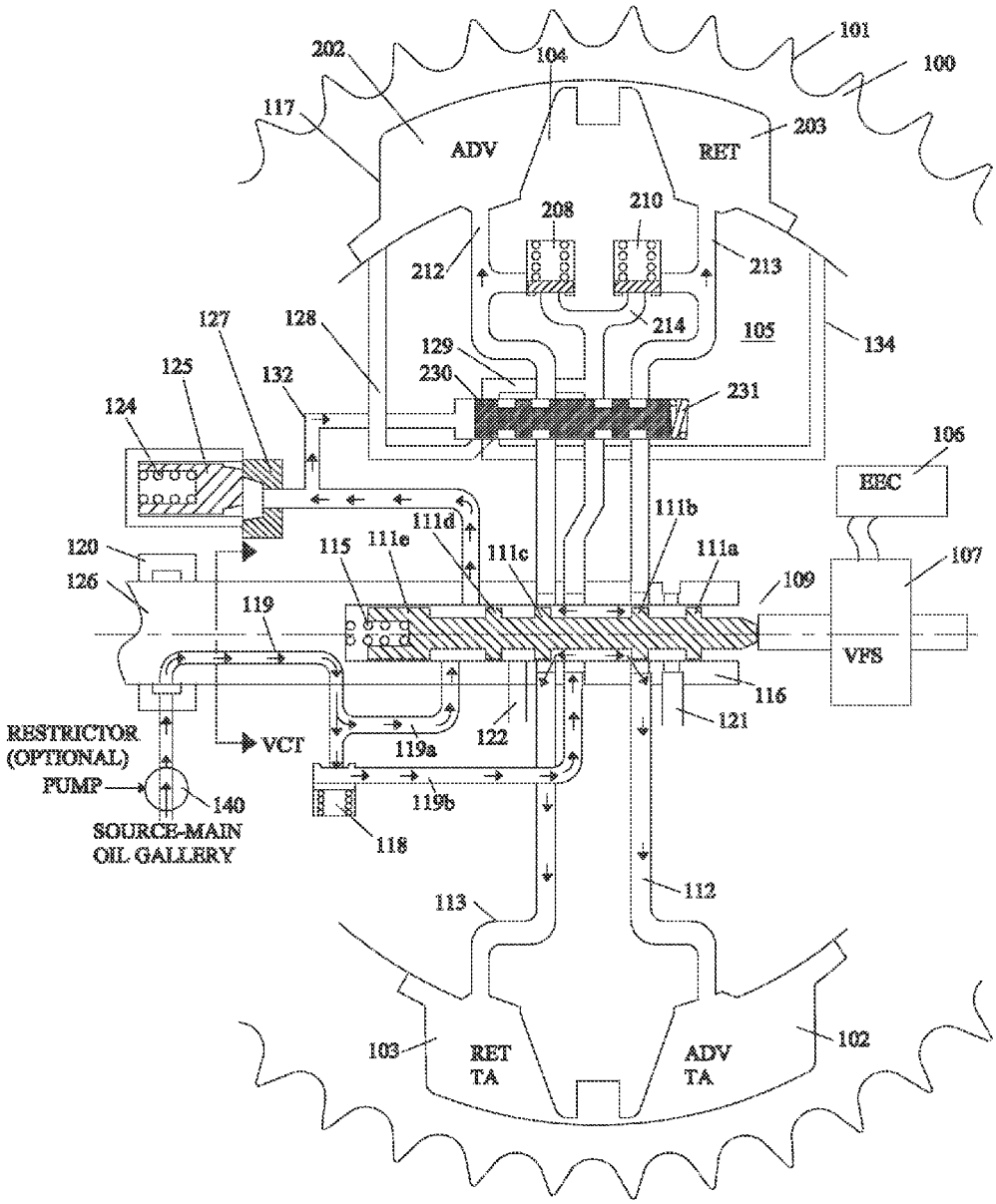
FIG. 7 shows a schematic of a second embodiment of a torsion assist (TA) phaser of the present invention with a hydraulic default circuit in a closed position and the control valve is in a holding position.
Figure 8:
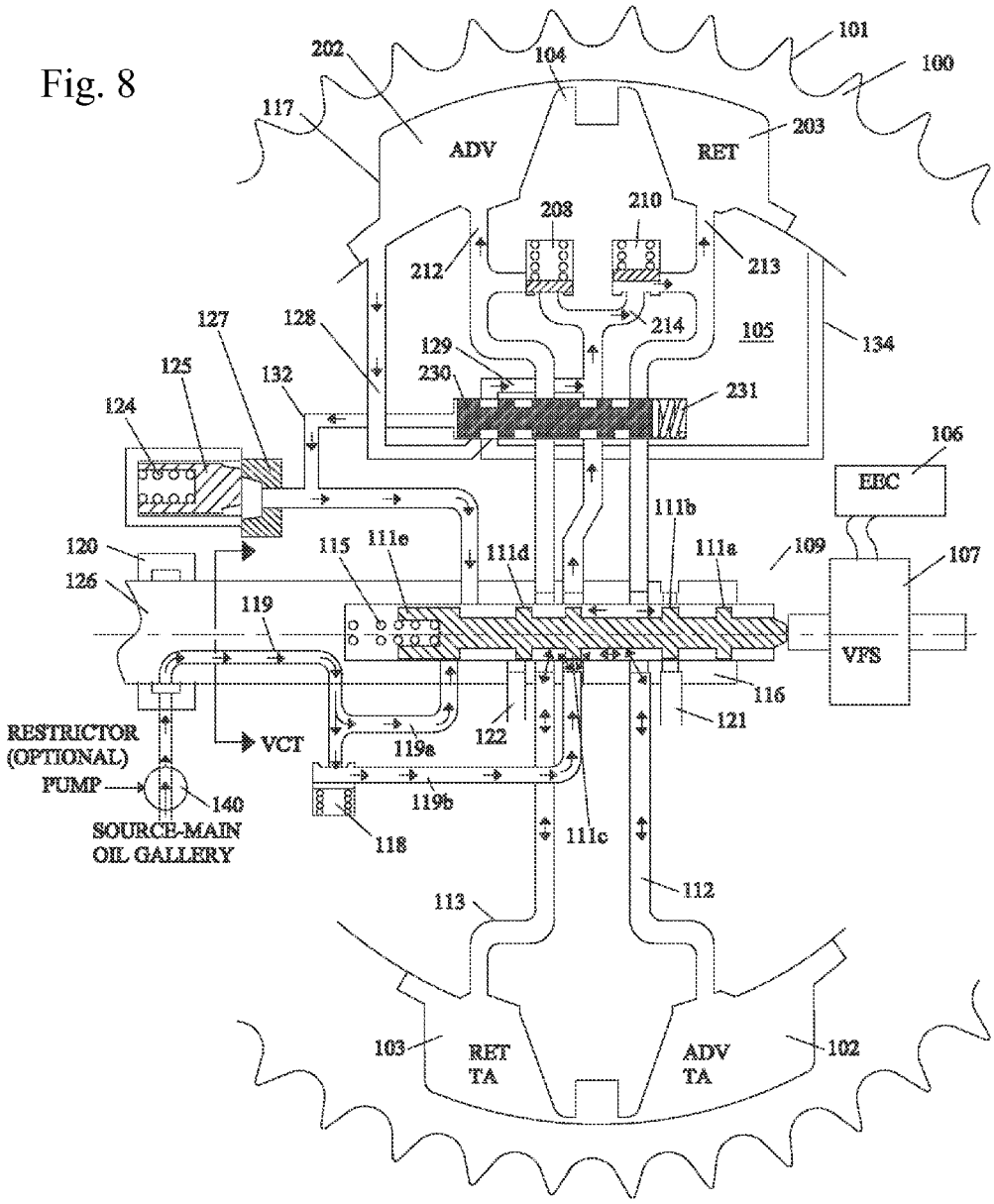
FIG. 8 shows a schematic of second embodiment of a torsion assist (TA) phaser of the present invention with a hydraulic default circuit in an open position and the control valve is in a default mode.

FIGS. 7-8 show a second embodiment of the present invention in which one set of torsion assist advance and retard chambers are switched to CTA mode in which fluid can recirculate back and forth between the advance chamber and the retard chamber. The main difference between the first embodiment and the second embodiment is that in the first embodiment all sets of the torsion assist advance and retard chambers 102, 103 are converted into the CTA mode when the default circuit 233 is on, as opposed to one set of torsion assist advance and retard chambers being converted to CTA mode when the default circuit is on. Furthermore, the control valve 109 opens a flow path between one or more sets of the TA advance and retard chambers 102, 103 while isolating one more sets of chambers 202, 203 in a CTA mode for the purpose of employing the hydraulic default circuit 103. When the default circuit 233 is off, the one set of chambers 202, 203 that were in CTA mode are converted back to functioning TA mode advance and retard chambers. One of the advantages of the phaser of this embodiment is that by only using a small number of chambers for the hydraulic default circuit, the phaser may operate faster in the hydraulic default mode, especially at high oil viscosities.

FIG. 7 shows the phaser in the holding position and the control valve in holding position. FIG. 8 shows the control valve 109 in the default mode and the hydraulic default circuit 233 on. The advance mode and retard mode are not shown, but are similar to FIGS. 1 and 2 of the first embodiment where the hydraulic default circuit 133 is off. The hydraulic default circuit 233 includes a spring 231 loaded piloted valve 230 and an advance default line 128 that connects the switched TA advance chamber 202 now in CTA mode to the piloted valve 230 and the common line 214, and a retard default line 134 that connects the switched TA retard chamber 203 now in CTA mode to the piloted valve 230 and the common line 214.

Referring to FIG. 7, the duty cycle of the variable force solenoid 107 is 50% and the force of the VFS 107 on one end of the spool 111 equals the force of the spring 115 on the opposite end of the spool 111 in holding position. The lands 111*b* and 111*c* block the flow of fluid between lines 112 and 113 leading to the TA advance and retard chambers and lines 212 and 213 leading to the advance and retard chambers 202, 203 to exhaust lines 122 and 121. However, spool lands 111*b* and 111*c* are positioned such that fluid may bleed into lines 112 and 113 leading to the advance and retard TA chambers 102, 103 and fluid may also bleed into or have restricted flow into the advance and retard chambers 202, 203 to make up for leakage through the piloted valve and lines 212 and 213.

Fluid is supplied to the phaser from supply S by pump 140 and enters line 119 through a cam interface 120. Line 119 splits into two lines 119*a* and 119*b*. Line 119*b* leads to inlet check valve 118 and the control valve 109. From the control valve 109, fluid enters lines 112, 113 leading to the TA advance and retard chambers 102, 103, applying the same pressure to the advance chamber 102 as the retard chamber 103, to hold the vane in position.

Line 119*a* leads to the piloted valve 230. The pressure of the fluid in line 119*a* moves through the spool 111 between lands 111*d* and 111*e* to line 132 to pressurize the piloted valve 230 against the spring 231, moving the piloted valve 230 to a position where retard default line 134, advance default line 128 are blocked and the default circuit is off. Exhaust line 122 is blocked by spool land 111*d*, preventing the default circuit 233 from venting or opening.

FIG. 8 shows the phaser in the mid position or intermediate phase angle position, where the duty cycle of the variable force solenoid is 0%, the spool 109 is in default mode, the piloted valve 230 is vented through the spool to passage 122 leading to sump or exhaust, and the hydraulic default circuit 233 is open or on. The one set of advance and retard chambers 202, 203 are switched from torsion assist mode to CTA mode.

Depending on where the vane 104 was prior to the duty cycle of the variable force solenoid 107 being changed to 0%, either the advance default line 128 or the retard default line 134 will be exposed to the CTA mode advance or retard chamber 202, 203 respectively. In addition, if the engine had an abnormal shut down (e.g. the engine stalled), when the engine is cranking, the duty cycle of the variable force solenoid 107 would be 0% the rotor assembly 105 would move via the default circuit to the mid position or intermediate phase angle position and the lock pin 125 would be engaged in mid position or intermediate phase angle position regardless of what position the vane 104 was in relative to the housing assembly 100 prior to the abnormal shut down of the engine.

The ability of the phaser of the present invention to default to a mid position or intermediate phase angle position without using electronic controls allows the phaser to move to the mid position or intermediate phase angle position even during engine cranking when electronic controls are not typically used for controlling the cam phaser position. In addition, since the phaser defaults to the mid position or intermediate phase angle position, it provides a fail safe position, especially if control signals or power or lost, that guarantees that the engine will be able to start and run even without active control over the VCT phaser. Since the phaser has the mid position or intermediate phase angle position upon cranking of the engine, longer travel of the phase of the phaser is possible, providing calibration opportunities. In the prior art, longer travel phasers or a longer phase angle is not possible, since the mid position or intermediate phase angle position is not present upon engine cranking and startup and the engine has difficulty starting at either the extreme advance or retard stops.

When the duty cycle of the variable force solenoid 107 is set to 0%, the force on the VFS on the spool 111 is decreased, and the spring 115 moves the spool 111 to the far right end of the spool's travel to a default mode as shown in the FIG. 8. In the default mode, spool land 111*b* blocks the flow of fluid from line 112 to exhaust line 121 and spool land 111*d* blocks the flow of fluid from line 113 to exhaust line 122, allowing fluid from supply to openly circulate between the TA advance and retard chambers, effectively removing control of the phaser from the control valve 109. At the same time, fluid from supply may flow through line 119 to line 119*b* and inlet check valve 118 to lines 112, 113 leading to the TA advance and retard chambers 102, 103 as described above and into common line 214, through the piloted valve 230 and through a check valve 208, 210 and into either the CTA mode advance chamber or CTA mode retard chamber through lines 212, 213.

Fluid is prevented from flowing through line 119*a* to the piloted valve 230 by spool land 111*e*. Since fluid cannot flow to line 119*a*, the piloted valve 230 vents to exhaust line 122, opening passage between the advance default line 128 and the retard default line 134 through the piloted valve 230 to line 229 and the common line 214, in other words, opening or turning on the hydraulic default circuit 233.

If the vane 104 was positioned within the housing assembly 100 near or in the retard position and the advance default line 128 is exposed to the CTA mode advance chamber 202, then fluid from the CTA mode advance chamber 202 will flow into the advance default line 128 and through the open piloted valve 230 and to line 229 leading to common line 214 as shown in FIG. 8. From the common line 214, fluid flows through check valve 210 and into the CTA mode retard chamber 203, moving the vane 104 relative to the housing assembly 100 to close off or block advance default line 128 to the CTA mode advance chamber 202. As the rotor assembly 105 closes off the advance default line 128 from the CTA mode advance chamber 202, the vane 104 is moved to a mid position or intermediate phase angle position within the chamber 117 formed between the housing assembly 100 and the rotor assembly 105.

If the vane 104 was positioned within the housing assembly 100 near or in the advance position and the retard default line 134 is exposed to the CTA mode retard chamber 203, then fluid from the CTA mode retard chamber 203 will flow into the retard default line 134 and through the open piloted valve 230 and to line 229 leading to common line 214. From the common line 214, fluid flows through check valve 208 and into the CTA mode advance chamber 202, moving the vane 104 relative to the housing assembly 100 to close off the retard default line 134 to the CTA mode retard chamber 203. As the rotor assembly 105 closes off line the retard default line 134 from the CTA mode retard chamber 203, the vane 104 is moved to a mid position or intermediate phase angle position within the chamber formed between the housing assembly 100 and the rotor assembly 105.

The advance default line 128 and the retard default line 134 are completely closed off or blocked by the rotor assembly 105 from the CTA mode advance and retard chambers 202, 203 when phaser is in the mid position or intermediate phase angle position, requiring that the lock pin 125 engages the recess 127 at the precise time in which the advance default line 128 or the retard default line 134 are closed off from their respective chambers. Alternatively, the advance default line 128 and the retard default line 134 may be slightly open or partially restricted to the CTA mode advance and retard chambers 202, 203, in the mid position or intermediate phase angle position to allow the rotor assembly 105 to oscillate slightly, increasing the likelihood the lock pin 125 will pass over the position of the recess 127 so the lock pin 125 can engage the recess 127.

Figure 15:
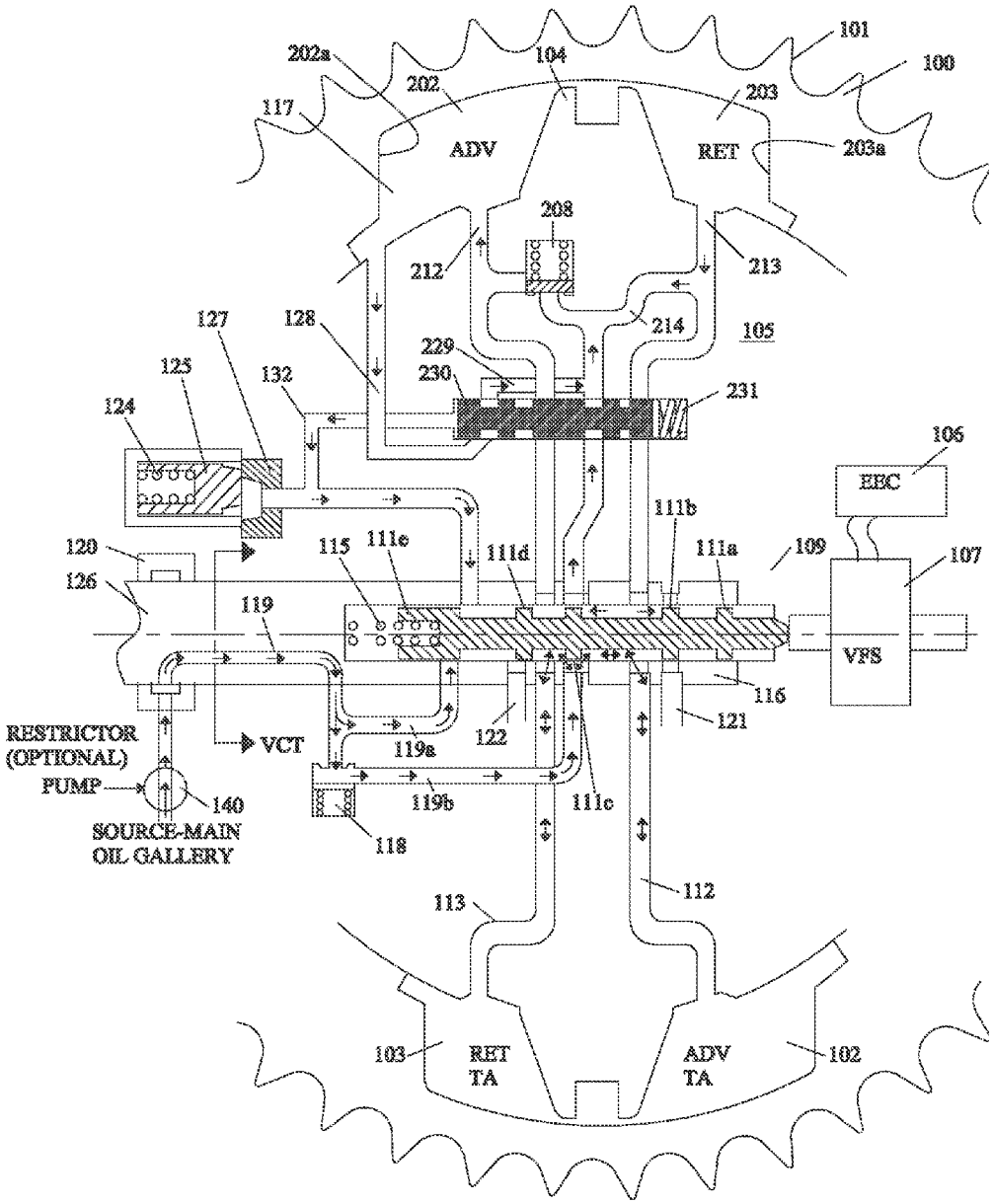
FIG. 15 shows a schematic of an alternative of the second embodiment of a torsion assist (TA) phaser of the present invention with a hydraulic default circuit for the advance chamber only.

FIG. 15 shows an alternate embodiment in which a default circuit 533 is present for the CTA mode advance chamber 202 only and assists in finding a mid position stop in one direction. The detent circuit 533 allows the phaser to oscillate between the mid position stop and one of the extreme stops, for example when the vane 104 is in contact with the advance wall 202*a* or the retard wall 203*a*.

The difference between the embodiment shown in FIG. 15 and the second embodiment of FIGS. 7-8 is the removal of the retard default line 134 and the check valve 210 between the common line 214, line 213 and the CTA mode retard chamber 203. For this embodiment, identical reference numbers as in the preceding figures apply to the same description above and are repeated herein by reference.

The hydraulic default circuit 533 includes a spring 231 loaded piloted valve 230 and an advance default line 128 that connects the switched TA advance chamber 202 now in CTA mode to the piloted valve 230 and the common line 214 to check valve 208. The advance default line 128 is a predetermined distance or length from the vane 104. The piloted valve 230 is in the rotor assembly 105 and is fluidly connected to the lock pin circuit 123 and line 119*a* through line 132. The lock pin circuit 123 includes the lock pin 125, lock pin spring 124, line 132, the piloted valve 230, supply line 119*a*, and exhaust line 122.

Depending on where the vane 104 was prior to the duty cycle of the variable force solenoid 107 being changed to 0%, fluid from the CTA mode retard chamber 203 will exit through line 213 and flow into common line 214, through check valve 208 to the CTA mode advance chamber 202 through line 212. As the CTA mode advance chamber 202 fills, the advance default line 128 is exposed and fluid in the CTA mode advance chamber 202 recirculates back to the CTA mode advance chamber 202 or CTA mode retard chamber 203 depending on the direction of cam torque through the piloted valve 230. Therefore, in the advance direction, the phaser can freely move until the vane 104 contacts the retard wall 203*a*.

In the default mode, spool land 111*b* blocks the flow of fluid from line 112 to exhaust line 121 and spool land 111*d* blocks the flow of fluid from line 113 to exhaust line 122, allowing fluid from supply to openly circulate between the TA advance and retard chambers 102, 103, effectively removing control of the phaser from the control valve 109. At the same time, fluid from supply may flow through line 119 to line 119*b* and inlet check valve 118 to lines 112, 113 leading to the TA advance and retard chambers 102, 103 as described above and into common line 214, through the piloted valve 230 and through check valve 208 and into the CTA mode advance chamber 202 through line 212 or to the CTA mode retard chamber 203 through line 213.

Fluid is prevented from flowing through line 119*a* to the piloted valve 230 by spool land 111*e*. Since fluid cannot flow to line 119*a*, the piloted valve 230 vents to exhaust line 122, opening passage between the advance default line 128 through the piloted valve 230 to line 229 and the common line 214, in other words, opening or turning on the hydraulic default circuit 533.

In the retard direction, when the hydraulic detent circuit is open, the phaser moves until the advance default line 128 is closed off by the housing 100. The advance default line 128 is closed off or blocked by the rotor assembly 105 from the CTA mode advance chamber 202 when phaser is in the mid position or intermediate phase angle position, requiring that the lock pin 125 engages the recess 127 at the precise time in which the advance default line 128 is closed off from its respective chambers. If the lock pin 125 doesn't engage the recess 127, the rotor 105 and vane 104 oscillates between a detent position where advance default line 128 is blocked by the housing 100 and full advance stop, (e.g. on the side with the shortest amount of travel between the mid position locking of the lock pin) where vane 104 contacts the retard wall 203*a*. When the phaser is oscillating, the lock pin 125 will eventually mate with the recess 127, locking the phaser in the mid position.

One of the advantages of only having a default line on one side of the phaser is decreased costs, since only one check valve is needed, not two and less drilling of the phaser is required.

It is preferable to have the check valve and default line on the side of the phaser with the longest travel for the lock pin to engage the recess and not have the check valve and default line with the shortest amount of travel for the lock pin to engage the recess, therefore limiting the amount of oscillation to the side, e.g. between the intermediate phase angle or mid position stop and the extreme stop and therefore the increased oscillation that does occur is on one end of the vane travel.

Alternatively, the check valve and default line on the opposite side, for example check valve 208 and advance default line 128 may also be removed.

Figure 9:
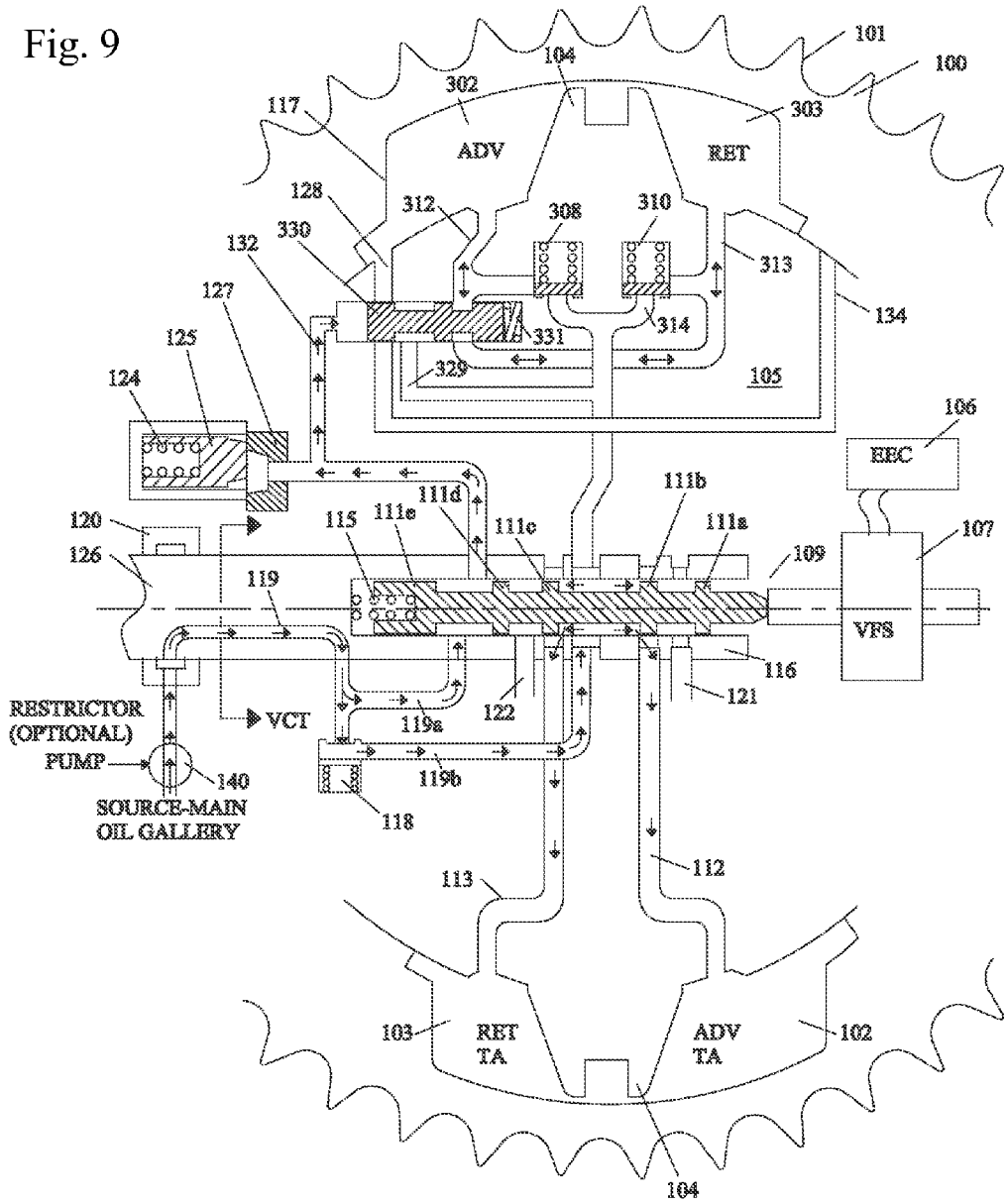
FIG. 9 shows a schematic of a third embodiment of a torsion assist (TA) phaser of the present invention with a hydraulic default circuit in a closed position and the control valve is in a holding position.
Figure 10:
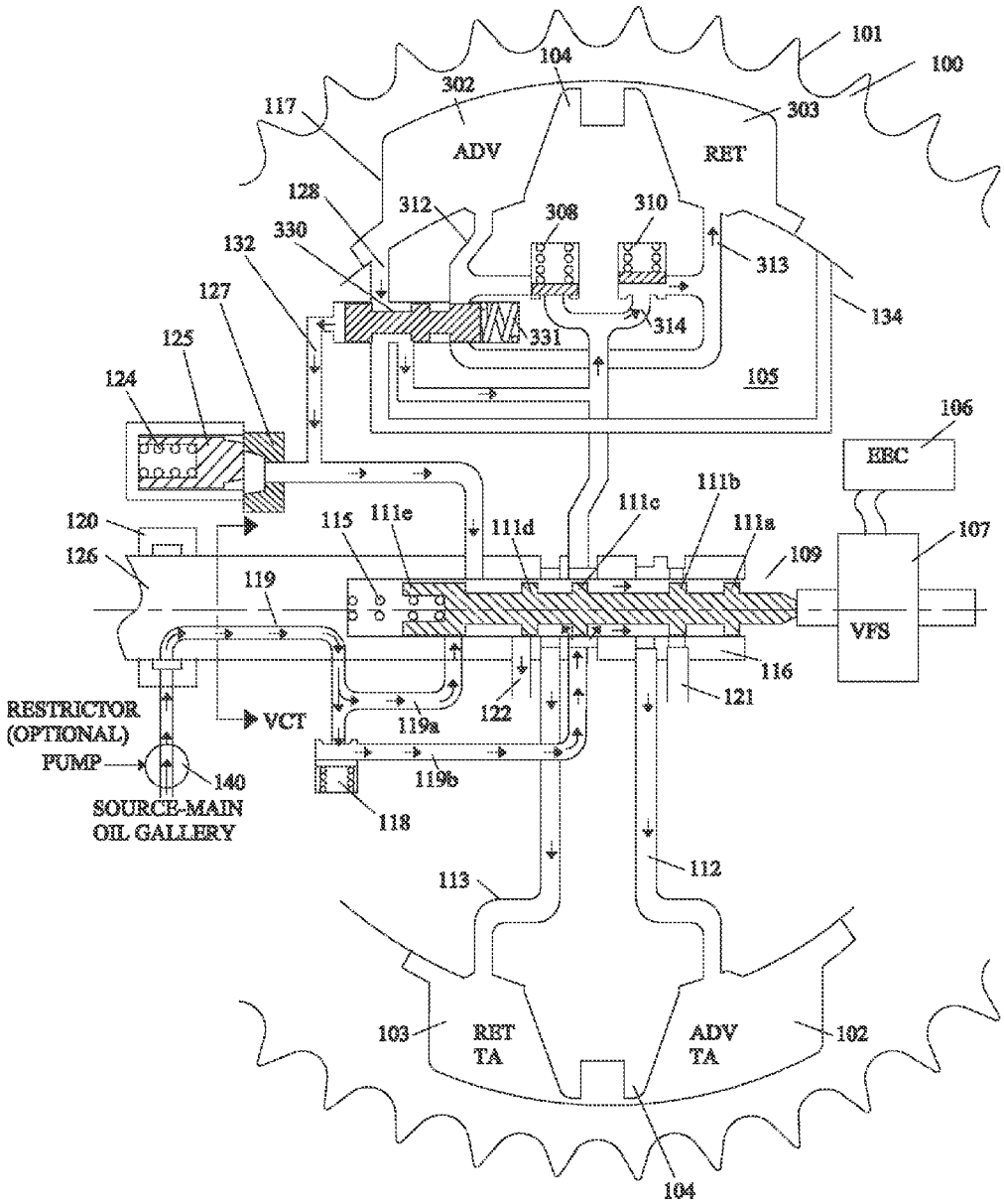
FIG. 10 shows a schematic of a third embodiment of a torsion assist (TA) phaser of the present invention with a hydraulic default circuit in an open position and the control valve is in a default mode.

FIGS. 9-10 show a third embodiment of the present invention in which one set of chambers 302, 303 is independently isolated from the torsion assist operating set(s) of chambers 102, 103 and only operate in CTA mode. In other words, the CTA mode set(s) of advance and retard chambers 302, 303 operates independently of the set(s) of torsion assist advance and retard chambers 102, 103. The third embodiment is similar to the second embodiment in that is has both torsion assist chambers 102, 103 and CTA mode chambers 302, 303, but the sets of chambers are isolated so that one or more sets of torsion assist working chambers 102, 103 control the position of the phaser when operating under closed loop control and there are one or more sets of CTA mode chambers 302, 303 to only function in the hydraulic default mode. A set of torsion assist working chambers 102, 103 are switched from "working" or advancing, retarding, or holding to recirculating via the control valve 109. A set of CTA mode chambers 302, 303 are switched from "working" or recirculating oil between the chambers to either advance or retard the chambers relative to reaching the mid position lock, to recirculating mode when the default valve is closed.

FIG. 9 shows the phaser in the holding position and the control valve in holding position. FIG. 10 shows the control valve 109 in the default mode and the hydraulic default circuit on 333 on. The advance mode and retard mode are not shown, but are similar to FIGS. 1 and 2 of the first embodiment where the hydraulic circuit 133 is off. The hydraulic default circuit 333 includes a spring 331 loaded piloted valve 330 and an advance default line 128 that connects the CTA mode advance chamber 302 to the piloted valve 330 and the common line 314, and a retard default line 134 that connects the CTA mode retard chamber 303 to the piloted valve 330 and the common line 314.

Referring to FIG. 9, the duty cycle of the variable force solenoid 107 is 50% and the force of the VFS 107 on one end of the spool 111 equals the force of the spring 115 on the opposite end of the spool 111 in holding position. The lands 111*b* and 111*c* block the flow of fluid from lines 112 and 113 leading to the TA advance and retard chambers 102, 103 and common line 314 from exhausting fluid to exhaust lines 122 and 121. Lines 112 and 113 are open to supplying fluid from supply to the torsion assist advance and retard chambers 102, 103. Fluid may also flow into common line 314 to make up for leakage through the piloted valve, check valves 308, 310 and lines 312 and 313 to the CTA mode advance and retard chambers 302, 303.

Fluid is supplied to the phaser from supply S by pump 140 and enters line 119 through a cam interface 120. Line 119 splits into two lines 119*a* and 119*b*. Line 119*b* leads to inlet check valve 118 and the control valve 109. Spool lands 111*b* and 111*c* are positioned such that fluid may bleed into lines 112 and 113, leading to the advance and retard TA chambers 102, 103, applying the same pressure to the advance chamber 102 as the retard chamber 103, to hold the vane in position.

Line 119*a* leads to the piloted valve 330. The pressure of the fluid in line 119*a* moves through the spool 111 between lands 111*d* and 111*e* to line 132 to pressurize the piloted valve 330 against the spring 331, moving the piloted valve 330 to a position where retard default line 134, advance default line 128 are blocked and the default circuit is off. Fluid can however move unrestricted and freely between the CTA advance chamber 302 and the CTA retard chamber 303 through the piloted valve 330 when the hydraulic default circuit 333 is off. Exhaust line 122 is blocked by spool land 111*d*, preventing the default circuit 333 from venting or opening.

FIG. 10 shows the phaser in the mid position or intermediate phase angle position, where the duty cycle of the variable force solenoid is 0%, the spool 109 is in default mode, spool land 111*c* is positioned such that the fluid from supply S 121 is open to flow freely between the advance torsion assist chamber 102 and the retard torsion assist chamber 103 an the piloted valve 330 is vented through the spool to passage 122 leading to sump or exhaust, and the hydraulic default circuit 333 is open or on.

Depending on where the vane 104 was prior to the duty cycle of the variable force solenoid 107 being changed to 0%, either the advance default line 128 or the retard default line 134 will be exposed to the CTA mode advance or retard chamber 302, 303 respectively. In addition, if the engine had an abnormal shut down (e.g. the engine stalled), when the engine is cranking, the duty cycle of the variable force solenoid 107 would be 0% the rotor assembly 105 would move via the default circuit to the mid position or intermediate phase angle position and the lock pin 125 would be engaged in mid position or intermediate phase angle position regardless of what position the vane 104 was in relative to the housing assembly 100 prior to the abnormal shut down of the engine.

The ability of the phaser of the present invention to default to a mid position or intermediate phase angle position without using electronic controls allows the phaser to move to the mid position or intermediate phase angle position even during engine cranking when electronic controls are not typically used for controlling the cam phaser position. In addition, since the phaser defaults to the mid position or intermediate phase angle position, it provides a fail safe position, especially if control signals or power or lost, that guarantees that the engine will be able to start and run even without active control over the VCT phaser. Since the phaser has the mid position or intermediate phase angle position upon cranking of the engine, longer travel of the phase of the phaser is possible, providing calibration opportunities. In the prior art, longer travel phasers or a longer phase angle is not possible, since the mid position or intermediate phase angle position is not present upon engine cranking and startup and the engine has difficulty starting at either the extreme advance or retard stops.

When the duty cycle of the variable force solenoid 107 is set to 0%, the force on the VFS on the spool 111 is decreased, and the spring 115 moves the spool 111 to the far right end of the spool's travel to a default mode as shown in the FIG. 10. In the default mode, spool land 111*b* blocks the flow of fluid from line 112 to exhaust line 121 and spool land 111*d* blocks the flow of fluid from line 113 to exhaust line 122, and spool land 111*c* is positioned to allow fluid from supply to openly or freely circulate between the TA advance and retard chambers 102, 103, effectively removing control of the phaser from the control valve 109. At the same time, fluid from supply may flow through line 119 to line 119*b* and inlet check valve 118 to lines 112, 113 leading to the TA advance and retard chambers 102, 103 as described above and into common line 314, and through a check valve 308, 310 and into either the CTA mode advance chamber 302 or CTA mode retard chamber 303 through lines 312, 313. The unrestricted flow of fluid between the CTA mode advance chamber 302 and the CTA mode retard chamber 303 is prevented by the piloted valve 330.

Fluid is prevented from flowing through line 119*a* to the piloted valve 330 by spool land 111*e*. Since fluid cannot flow to line 119*a*, the piloted valve 330 vents to exhaust line 122, opening passage between the advance default line 128 and the retard default line 134 through the piloted valve 330 to line 329 and the common line 314, in other words, opening or turning on the hydraulic default circuit 333.

If the vane 104 was positioned within the housing assembly 100 near or in the retard position and the advance default line 128 is exposed to the CTA mode advance chamber 302, then fluid from the CTA mode advance chamber 302 will flow into the advance default line 128 and through the open piloted valve 330 and to line 329 leading to common line 314 as shown in FIG. 10. From the common line 314, fluid flows through check valve 310 and into the CTA mode retard chamber 303, moving the vane 104 relative to the housing assembly 100 to close off or block advance default line 128 to the CTA mode advance chamber 302. As the rotor assembly 105 closes off the advance default line 128 from the CTA mode advance chamber 302, the vane 104 is moved to a mid position or intermediate phase angle position within the chamber 117 formed between the housing assembly 100 and the rotor assembly 105.

If the vane 104 was positioned within the housing assembly 100 near or in the advance position and the retard default line 134 is exposed to the CTA mode retard chamber 303, then fluid from the CTA mode retard chamber 303 will flow into the retard default line 134 and through the open piloted valve 330 and to line 329 leading to common line 314. From the common line 314, fluid flows through check valve 308 and into the CTA mode advance chamber 302, moving the vane 104 relative to the housing assembly 100 to close off the retard default line 134 to the CTA mode retard chamber 303. As the rotor assembly 105 closes off line the retard default line 134 from the CTA mode retard chamber 303, the vane 104 is moved to a mid position or intermediate phase angle position within the chamber formed between the housing assembly 100 and the rotor assembly 105.

The advance default line 128 and the retard default line 134 are completely closed off or blocked by the rotor assembly 105 from the CTA mode advance and retard chambers 302, 303 when phaser is in the mid position or intermediate phase angle position, requiring that the lock pin 125 engages the recess 127 at the precise time in which the advance default line 128 or the retard default line 134 are closed off from their respective chambers. Alternatively, the advance default line 128 and the retard default line 134 may be slightly open or partially restricted to the CTA mode advance and retard chambers 302, 303, in the mid position or intermediate phase angle position to allow the rotor assembly 105 to oscillate slightly, increasing the likelihood the lock pin 125 will pass over the position of the recess 127 so the lock pin 125 can engage the recess 127.

Figure 16:
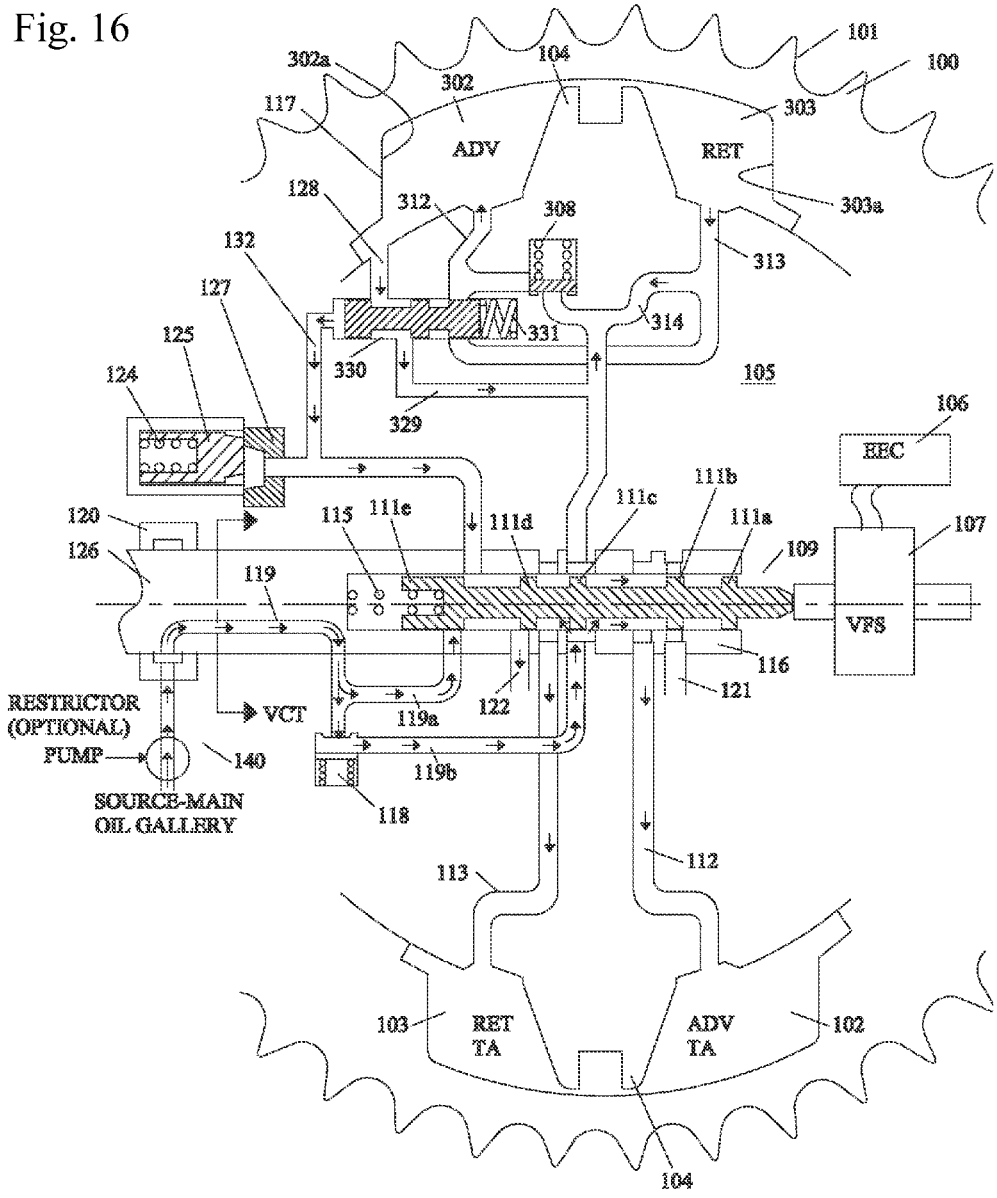
FIG. 16 shows a schematic of an alternative of the third embodiment of a torsion assist (TA) phaser of the present invention with a hydraulic default circuit for the advance chamber only.

FIG. 16 shows an alternate embodiment in which a default circuit 633 is present for the CTA mode retard chamber 303 only and assists in finding a mid position stop in one direction. The detent circuit 633 allows the phaser to oscillate between the mid position stop and one of the extreme stops, for example when the vane 104 is in contact with the retard wall 303*a* or the advance wall 302*a*.

The difference between the embodiment shown in FIG. 16 and the third embodiment of FIGS. 9-10 is the removal of the advance retard default line 134 and the check valve 310 between the common line 314, line 313 and the CTA mode retard chamber 303. For this embodiment, identical reference numbers as in the preceding figures apply to the same description above and are repeated herein by reference.

The hydraulic default circuit 333 includes a spring 331 loaded piloted valve 330 and an advance default line 128 that connects the CTA mode advance chamber 302 to the piloted valve 330 and the common line 314 to check valve 308. The advance default line 128 is a predetermined distance or length from the vane 104. The piloted valve 330 is in the rotor assembly 105 and is fluidly connected to the lock pin circuit 123 and line 119*a* through line 132. The lock pin circuit 123 includes the lock pin 125, lock pin spring 124, line 132, the piloted valve 330, supply line 119*a*, and exhaust line 122.

Depending on where the vane 104 was prior to the duty cycle of the variable force solenoid 107 being changed to 0%, fluid from the CTA mode retard chamber 303 will exit through line 313 and flow into common line 314, through check valve 308 to the CTA mode advance chamber 302 through line 312. As the CTA mode advance chamber 302 fills, the advance default line 128 is exposed and fluid in the CTA mode advance chamber 302 recirculates back to the CTA mode advance chamber 302 or CTA mode retard chamber 303 depending on the direction of cam torque through the piloted valve 230. Therefore, in the advance direction, the phaser can freely move until the vane 104 contacts the retard wall 303*a*.

In the default mode, spool land 111*b* blocks the flow of fluid from line 112 to exhaust line 121 and spool land 111*d* blocks the flow of fluid from line 113 to exhaust line 122, allowing fluid from supply to openly circulate between the TA advance and retard chambers 102, 103, effectively removing control of the phaser from the control valve 109. At the same time, fluid from supply may flow through line 119 to line 119*b* and inlet check valve 118 to lines 112, 113 leading to the TA advance and retard chambers 102, 103 as described above and into common line 314, through the piloted valve 330 and through a check valve 308 into the CTA mode advance chamber 302 through line 312 and through to the CTA mode retard chamber 302 through line 313.

Fluid is prevented from flowing through line 119*a* to the piloted valve 330 by spool land 111*e*. Since fluid cannot flow to line 119*a*, the piloted valve 330 vents to exhaust line 122, opening passage between the advance default line 128 through the piloted valve 330 to line 329 and the common line 214, in other words, opening or turning on the hydraulic default circuit 633.

In the retard direction, when the hydraulic detent circuit is open, the phaser moves until the advance default line 128 is closed off by the housing 100. The advance default line 128 is closed off or blocked by the rotor assembly 105 from the CTA mode advance chamber 302 when phaser is in the mid position or intermediate phase angle position, requiring that the lock pin 125 engages the recess 127 at the precise time in which the advance default line 128 is closed off from its respective chambers. If the lock pin 125 doesn't engage the recess 127, the rotor 105 and vane 104 oscillates between a detent position where advance default line 128 is blocked by the housing 100 and full advance stop, (e.g. on the side with the shortest amount of travel between the mid position locking of the lock pin) where vane 104 contacts the retard wall 203*a*. When the phaser is oscillating, the lock pin 125 will eventually mate with the recess 127, locking the phaser in the mid position.

One of the advantages of only having a default line on one side of the phaser is decreased costs, since only one check valve is needed, not two and less drilling of the phaser is required.

It is preferable to have the check valve and default line on the side of the phaser with the longest travel for the lock pin to engage the recess and not have the check valve and default line with the shortest amount of travel for the lock pin to engage the recess, therefore limiting the amount of oscillation to the side, e.g. between the intermediate phase angle or mid position stop and the extreme stop and therefore the increased oscillation that does occur is on one end of the vane travel.

Alternatively, the check valve and default line on the opposite side, for example check valve 308 and advance default line 128 may also be removed.

Figure 11:
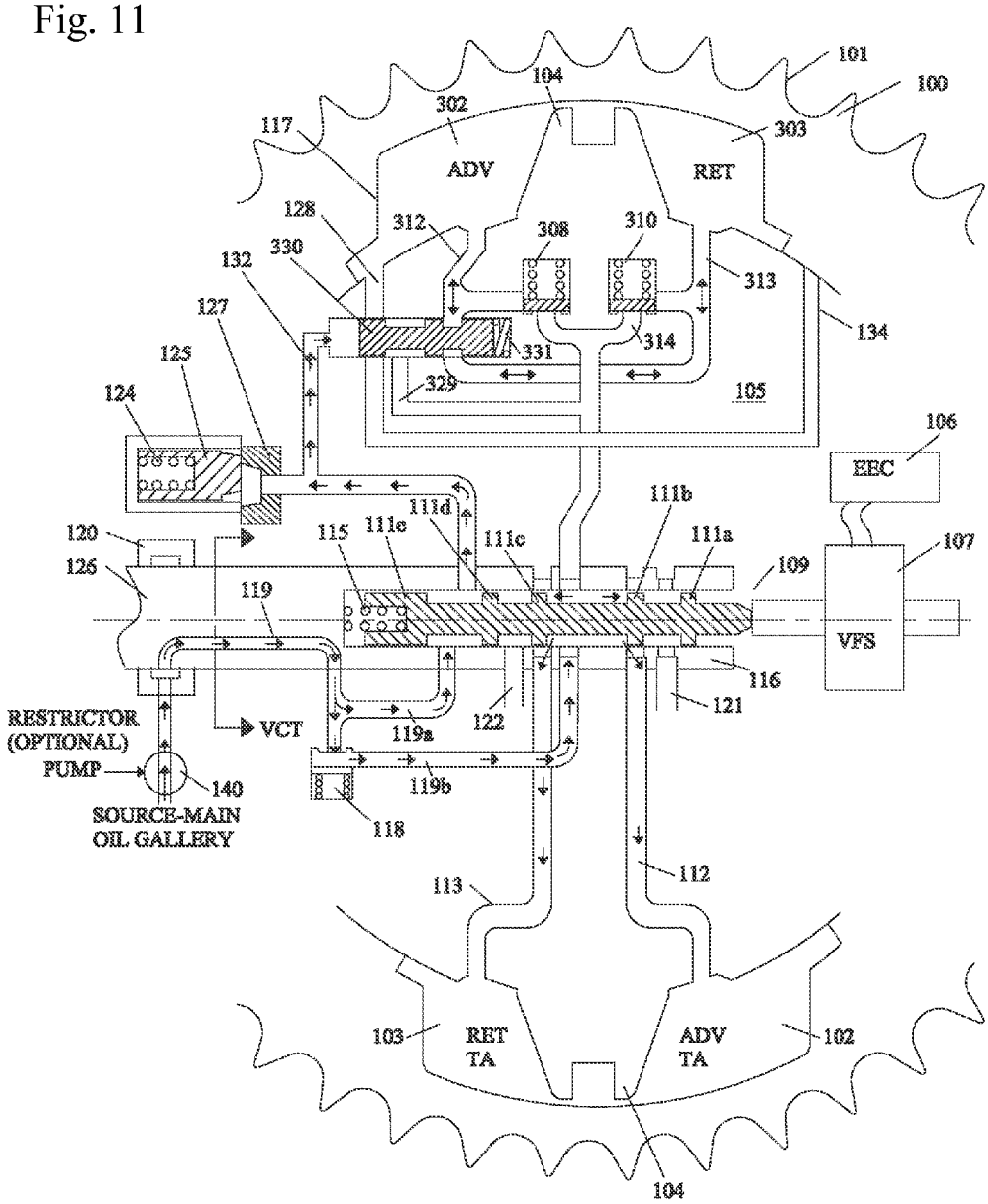
FIG. 11 shows a schematic of a fourth embodiment of a torsion assist (TA) phaser of the present invention with a hydraulic default circuit in a closed position and the control valve is in holding position.
Figure 12:
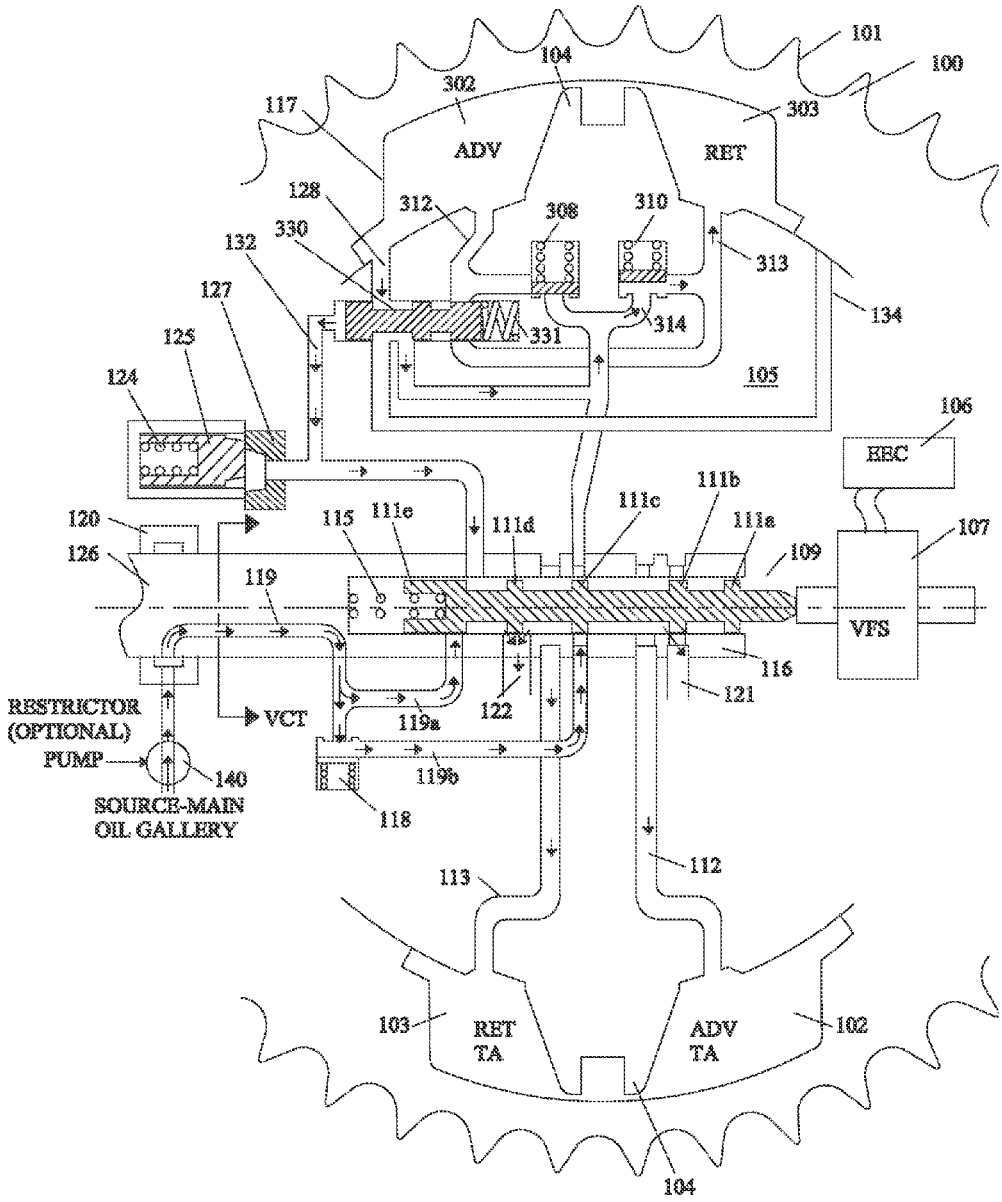
FIG. 12 shows a schematic of a fourth embodiment of a torsion assist (TA) phaser of the present invention with a hydraulic default circuit in an open position and the control valve is in a default mode.

FIGS. 11-12 show a fourth embodiment of the present invention in which one set of chambers 302, 303 is independently isolated from the torsion assist operating set(s) of chambers 102, 103 and only operate in CTA mode similar to the third embodiment. In other words, the CTA mode set(s) of advance and retard chambers 302, 303 operates independently of the set(s) of torsion assist advance and retard chambers 102, 103. In the fourth embodiment, the chambers are isolated so that one or more sets of torsion assist working chambers 102, 103 control the position of the phaser when operating under closed loop control and there are one or more sets of CTA mode chambers 302, 303 to only function in the hydraulic default mode. A set of torsion assist working chambers 102, 103 are switched from "working" or advancing, retarding, or holding to a position in which the torsion assist chambers 102, 103 are opened and exhausted through the control valve 109. A set of CTA mode chambers 302, 303 are switched from "working" or recirculating oil between the chambers to either advance or retard the chambers relative to reaching the mid position lock, to recirculating mode when the default valve is closed.

FIG. 11 shows the phaser in the holding position and the control valve in holding position. FIG. 12 shows the control valve 109 in the default mode and the hydraulic default circuit on 333 on. The advance mode and retard mode are not shown, but are similar to FIGS. 1 and 2 of the first embodiment where the hydraulic circuit 133 is off. The hydraulic default circuit 333 includes a spring 331 loaded piloted valve 330 and an advance default line 128 that connects the CTA mode advance chamber 302 to the piloted valve 330 and the common line 314, and a retard default line 134 that connects the CTA mode retard chamber 303 to the piloted valve 330 and the common line 314.

Referring to FIG. 11, the duty cycle of the variable force solenoid 107 is 50% and the force of the VFS 107 on one end of the spool 111 equals the force of the spring 115 on the opposite end of the spool 111 in holding position. The lands 111*b* and 111*c* block the flow of fluid between lines 112 and 113 leading to the TA advance and retard chambers 102, 103 and prevent fluid from the TA advance and retard chambers 102, 103 form exhausting to exhaust lines 122, 121. However, spool lands 111*b* and 111*c* are positioned such that fluid may bleed into or have restricted flow into lines 112 and 113 leading to the advance and retard chambers 102, 103 and fluid may also bleed into or have restricted flow into the CTA mode advance and retard chambers 302, 303 through common line 314 and check valves 308, 310 to make up for leakage.

Fluid is supplied to the phaser from supply S by pump 140 and enters line 119 through a cam interface 120. Line 119 splits into two lines 119*a* and 119*b*. Line 119*b* leads to inlet check valve 118 and the control valve 109. From the control valve 109, fluid enters lines 112, 113 leading to the TA advance and retard chambers 102, 103, applying the same pressure to the advance chamber 102 as the retard chamber 103, to hold the vane in position.

Line 119*a* leads to the piloted valve 330. The pressure of the fluid in line 119*a* moves through the spool 111 between lands 111*d* and 111*e* to line 132 to pressurize the piloted valve 330 against the spring 331, moving the piloted valve 330 to a position where retard default line 134, advance default line 128 are blocked and the default circuit is off. Fluid can however move unrestricted and freely between the CTA advance chamber 302 and the CTA retard chamber 303 through the piloted valve 330 when the hydraulic default circuit 333 is off. Exhaust line 122 is blocked by spool land 111*d*, preventing the default circuit 333 from venting or opening.

FIG. 12 shows the phaser in the mid position or intermediate phase angle position, where the duty cycle of the variable force solenoid is 0%, the spool 109 is in default mode, the piloted valve 330 is vented through the spool to passage 122 leading to sump or exhaust, and the hydraulic default circuit 333 is open or on. With the hydraulic default circuit 333 on or open, fluid from the advance torsion assist chamber 102 and the retard torsion assist chamber 103 empty out to sump through exhaust lines 121 and 122. Therefore, the only set of chambers that has fluid when the spool is fully out or in default mode is the one or more sets of CTA mode advance and retard chambers 302, 303. Fluid from supply S may flow into common line 314 through an annulus (not shown) on the outer diameter of the sleeve 116.

Depending on where the vane 104 was prior to the duty cycle of the variable force solenoid 107 being changed to 0%, either the advance default line 128 or the retard default line 134 will be exposed to the CTA mode advance or retard chamber 302, 303 respectively. In addition, if the engine had an abnormal shut down (e.g. the engine stalled), when the engine is cranking, the duty cycle of the variable force solenoid 107 would be 0% the rotor assembly 105 would move via the default circuit to the mid position or intermediate phase angle position and the lock pin 125 would be engaged in mid position or intermediate phase angle position regardless of what position the vane 104 was in relative to the housing assembly 100 prior to the abnormal shut down of the engine.

The ability of the phaser of the present invention to default to a mid position or intermediate phase angle position without using electronic controls allows the phaser to move to the mid position or intermediate phase angle position even during engine cranking when electronic controls are not typically used for controlling the cam phaser position. In addition, since the phaser defaults to the mid position or intermediate phase angle position, it provides a fail safe position, especially if control signals or power or lost, that guarantees that the engine will be able to start and run even without active control over the VCT phaser. Since the phaser has the mid position or intermediate phase angle position upon cranking of the engine, longer travel of the phase of the phaser is possible, providing calibration opportunities. In the prior art, longer travel phasers or a longer phase angle is not possible, since the mid position or intermediate phase angle position is not present upon engine cranking and startup and the engine has difficulty starting at either the extreme advance or retard stops.

When the duty cycle of the variable force solenoid 107 is just set to 0%, the force on the VFS on the spool 111 is decreased, and the spring 115 moves the spool 111 to the far right end of the spool's travel to a default mode as shown in the FIG. 12. In the default mode, spool land 111*c* blocks the flow of fluid from supply line 119*b* into lines 112 and 113 leading to the TA advance and retard chambers 102, 103. Instead lines 112 and 113 are open to exhaust lines 121 and 122 respectively, exhausting the fluid from the TA advance and retard chambers, effectively removing control of the phaser from the control valve 109. At the same time, fluid from supply may flow through line 119 to line 119*b* and inlet check valve 118 to an annulus (not shown) on the outer diameter of the sleeve 116 to common line 314, and through a check valve 308, 310 and into either the CTA mode advance chamber 302 or CTA mode retard chamber 303 through lines 312, 313. The unrestricted flow of fluid between the CTA mode advance chamber 302 and the CTA mode retard chamber 303 is prevented by the piloted valve 330.

Fluid is prevented from flowing through line 119*a* to the piloted valve 330 by spool land 111*e*. Since fluid cannot flow to line 119*a*, the piloted valve 330 vents to exhaust line 122, opening passage between the advance default line 128 and the retard default line 134 through the piloted valve 330 to line 329 and the common line 314, in other words, opening or turning on the hydraulic default circuit 333.

If the vane 104 was positioned within the housing assembly 100 near or in the retard position and the advance default line 128 is exposed to the CTA mode advance chamber 302, then fluid from the CTA mode advance chamber 302 will flow into the advance default line 128 and through the open piloted valve 330 and to line 329 leading to common line 314 as shown in FIG. 12. From the common line 314, fluid flows through check valve 310 and into the CTA mode retard chamber 303, moving the vane 104 relative to the housing assembly 100 to close off or block advance default line 128 to the CTA mode advance chamber 302. As the rotor assembly 105 closes off the advance default line 128 from the CTA mode advance chamber 302, the vane 104 is moved to a mid position or intermediate phase angle position within the chamber 117 formed between the housing assembly 100 and the rotor assembly 105.

If the vane 104 was positioned within the housing assembly 100 near or in the advance position and the retard default line 134 is exposed to the CTA mode retard chamber 303, then fluid from the CTA mode retard chamber 303 will flow into the retard default line 134 and through the open piloted valve 330 and to line 329 leading to common line 314. From the common line 314, fluid flows through check valve 308 and into the CTA mode advance chamber 302, moving the vane 104 relative to the housing assembly 100 to close off the retard default line 134 to the CTA mode retard chamber 303. As the rotor assembly 105 closes off line the retard default line 134 from the CTA mode retard chamber 203, the vane 104 is moved to a mid position or intermediate phase angle position within the chamber formed between the housing assembly 100 and the rotor assembly 105.

The advance default line 128 and the retard default line 134 are completely closed off or blocked by the rotor assembly 105 from the CTA mode advance and retard chambers 302, 303 when phaser is in the mid position or intermediate phase angle position, requiring that the lock pin 125 engages the recess 127 at the precise time in which the advance default line 128 or the retard default line 134 are closed off from their respective chambers. Alternatively, the advance default line 128 and the retard default line 134 may be slightly open or partially restricted to the CTA mode advance and retard chambers 302, 303, in the mid position or intermediate phase angle position to allow the rotor assembly 105 to oscillate slightly, increasing the likelihood the lock pin 125 will pass over the position of the recess 127 so the lock pin 125 can engage the recess 127.

Figure 17:
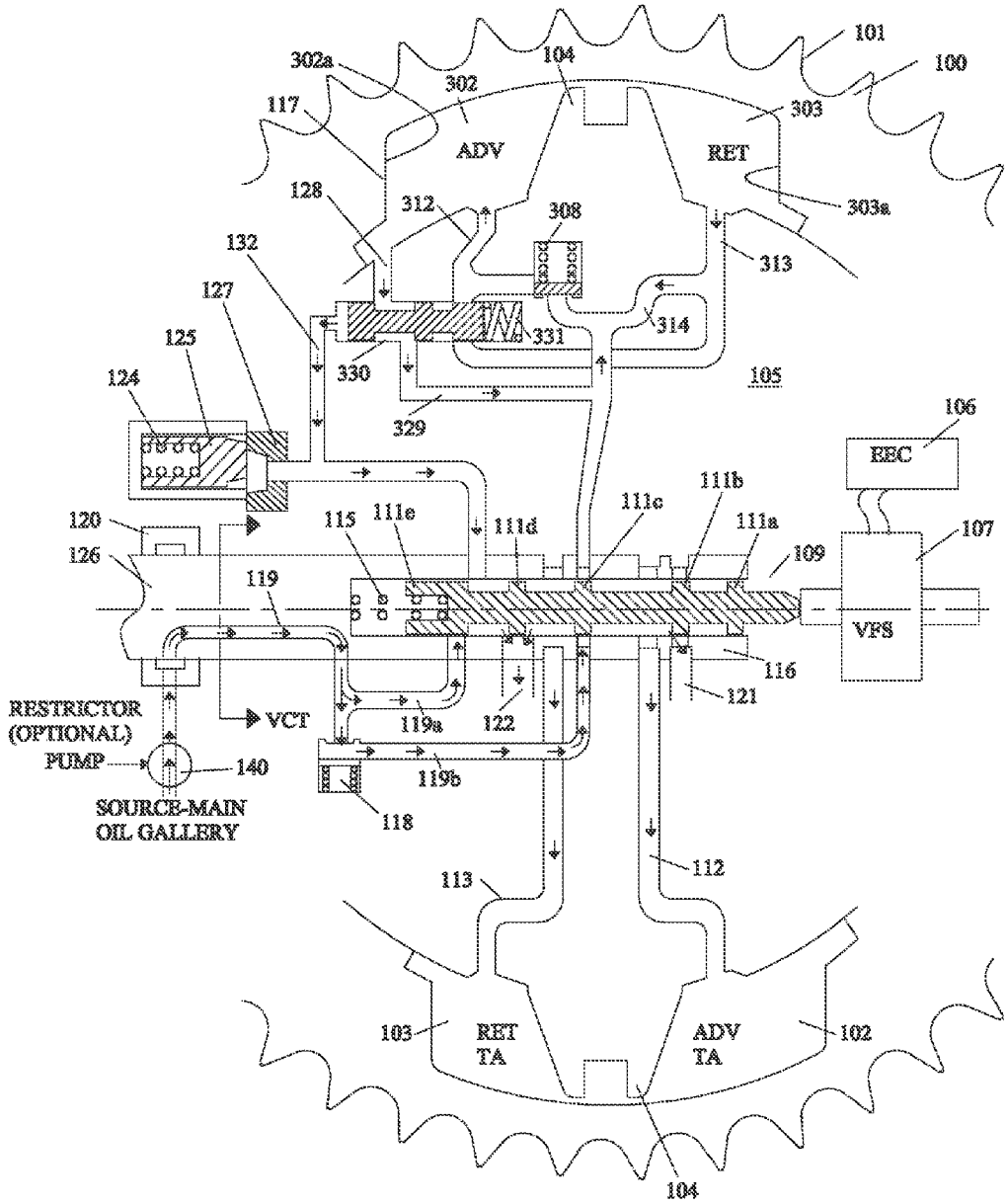
FIG. 17 shows a schematic of an alternative of the fourth embodiment of a torsion assist (TA) phaser of the present invention with a hydraulic default circuit for the advance chamber only.

FIG. 17 shows an alternate embodiment in which a default circuit 733 is present for the CTA mode retard chamber 303 only and assists in finding a mid stop position in one direction. The detent circuit 733 allows the phaser to oscillate between the mid stop position and one of the extreme stops, for example when the vane 104 is in contact with the retard wall 303*a* or the advance wall 302*a*.

The difference between the embodiment shown in FIG. 17 and the fourth embodiment of FIGS. 11-12 is the removal of the advance retard default line 134 and the check valve 310 between the common line 314, line 313 and the CTA mode retard chamber 303. For this embodiment, identical reference numbers as in the preceding figures apply to the same description above and are repeated herein by reference.

The hydraulic default circuit 333 includes a spring 331 loaded piloted valve 330 and an advance default line 128 that connects the CTA mode advance chamber 302 to the piloted valve 330 and the common line 314 to check valve 308. The advance default line 128 is a predetermined distance or length from the vane 104. The piloted valve 330 is in the rotor assembly 105 and is fluidly connected to the lock pin circuit 123 and line 119*a* through line 132. The lock pin circuit 123 includes the lock pin 125, lock pin spring 124, line 132, the piloted valve 330, supply line 119*a*, and exhaust line 122. With the hydraulic default circuit 733 on or open, fluid from the advance torsion assist chamber 102 and the retard torsion assist chamber 103 empty out to sump through exhaust lines 121 and 122. Therefore, the only set of chambers that has fluid when the spool is fully out or in default mode is the one or more sets of CTA mode advance and retard chambers 302, 303. Fluid from supply S may flow into common line 314 through an annulus (not shown) on the outer diameter of the sleeve 116.

Depending on where the vane 104 was prior to the duty cycle of the variable force solenoid 107 being changed to 0%, fluid from the CTA mode retard chamber 303 will exit through line 313 and flow into common line 314, through check valve 308 to the CTA mode advance chamber 302 through line 312. As the CTA mode advance chamber 302 fills, the advance default line 128 is exposed and fluid in the CTA mode advance chamber 302 recirculates back to the CTA mode advance chamber 302 or CTA mode retard chamber 303 depending on the direction of cam torque through the piloted valve 230. Therefore, in the advance direction, the phaser can freely move until the vane 104 contacts the retard wall 303*a*.

In the default mode, spool land 111*b* allows the flow of fluid from line 112 to exhaust line 121 and spool land 111*d* allows the flow of fluid from line 113 to exhaust line 122, allowing fluid from the TA advance and retard chambers to empty to sump. At the same time, fluid from supply may flow through line 119 to line 119*b* and inlet check valve 118 to common line 314 and through the piloted valve 330 and through a check valve 308 into the CTA mode advance chamber 302 and through to the CTA mode retard chamber 302 through lines 312, 313.

Fluid is prevented from flowing through line 119*a* to the piloted valve 330 by spool land 111*e*. Since fluid cannot flow to line 119*a*, the piloted valve 330 vents to exhaust line 122, opening passage between the advance default line 128 through the piloted valve 330 to line 329 and the common line 314, in other words, opening or turning on the hydraulic default circuit 733.

In the retard direction, when the hydraulic detent circuit is open, the phaser moves until the advance default line 128 is closed off by the housing 100. The advance default line 128 is closed off or blocked by the rotor assembly 105 from the CTA mode advance chamber 302 when phaser is in the mid position or intermediate phase angle position, requiring that the lock pin 125 engages the recess 127 at the precise time in which the advance default line 128 is closed off from its respective chambers. If the lock pin 125 doesn't engage the recess 127, the rotor 105 and vane 104 oscillates between a detent position where advance default line 128 is blocked by the housing 100 and full advance stop, (e.g. on the side with the shortest amount of travel between the mid position locking of the lock pin) where vane 104 contacts the retard wall 303*a*. When the phaser is oscillating, the lock pin 125 will eventually mate with the recess 127, locking the phaser in the mid position.

One of the advantages of only having a default line on one side of the phaser is decreased costs, since only one check valve is needed, not two and less drilling of the phaser is required.

It is preferable to have the check valve and default line on the side of the phaser with the longest travel for the lock pin to engage the recess and not have the check valve and default line with the shortest amount of travel for the lock pin to engage the recess, therefore limiting the amount of oscillation to the side, e.g. between the intermediate phase angle or mid position stop and the extreme stop and therefore the increased oscillation that does occur is on one end of the vane travel.

Alternatively, the check valve and default line on the opposite side, for example check valve 308 and advance default line 128 may also be removed.

Figure 13:
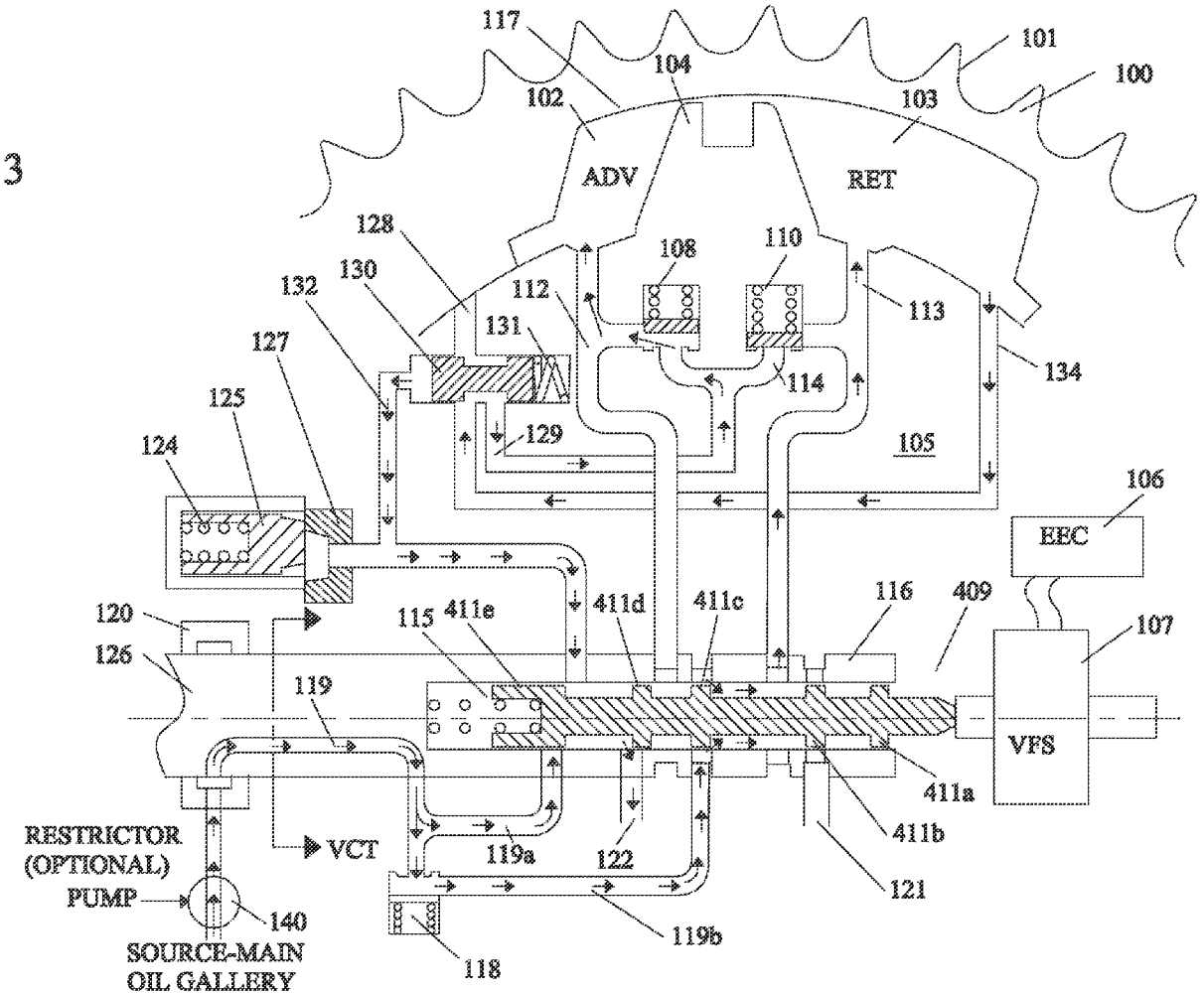
FIG. 13 shows a schematic of a fifth embodiment of a torsion assist (TA) phaser of the present invention with a hydraulic default circuit in an open position and the control valve in a default mode.

FIG. 13 shows a fifth embodiment of the present invention in which when the hydraulic detent circuit 133 is open and the control valve 409 is in the default mode, the control valve 409 blocks exhaust ports 121, 122 and hydraulic fluid is supplied to either the advance chamber 102 or the retard chamber 103 and the hydraulic detent circuit 133 supplies fluid to the other advance or retard chamber 102, 103.

The housing assembly 100 of the phaser has an outer circumference 101 for accepting drive force. The rotor assembly 105 is connected to the camshaft 126 and is coaxially located within the housing assembly 100. The rotor assembly 105 has a vane 104 separating a chamber 117 formed between the housing assembly 100 and the rotor assembly 105 into an advance chamber 102 and a retard chamber 103. The vane 104 is capable of rotation to shift the relative angular position of the housing assembly 100 and the rotor assembly 105. Additionally, a hydraulic default circuit 133 and a lock pin circuit 123 are also present. The hydraulic default circuit 133 and the lock pin circuit 123 are essentially one circuit as discussed above, but will be discussed separately for simplicity.

The hydraulic default circuit 133 includes a spring 131 loaded piloted valve 130 and an advance default line 128 that connects the advance chamber 102 to the piloted valve 130 and the common line 114 to check valves 108, 110, and a retard default line 134 that connects the retard chamber 103 to the piloted valve 130 and the common line 114 to check valves 108, 110. The advance default line 128 and the retard default line 134 are a predetermined distance or length from the vane 104. The piloted valve 130 is in the rotor assembly 105 and is fluidly connected to the lock pin circuit 123 and line 119*a* through line 132. The lock pin circuit 123 includes the lock pin 125, line 132, the piloted valve 130, supply line 119*a*, and exhaust line 122.

The lock pin 125 is slidably housed in a bore in the rotor assembly 105 and has an end portion that is biased towards and fits into a recess 127 in the housing assembly 100 by a spring 124. Alternatively, the lock pin 125 may be housed in the housing assembly 100 and be spring 124 biased towards a recess 127 in the rotor assembly 105. The opening and closing of the hydraulic default circuit 133 and pressurization of the lock pin circuit 123 are both controlled by the switching/movement of the phase control valve 109.

A control valve 409, preferably a spool valve, includes a spool 411 with cylindrical lands 411*a*, 411*b*, 411*c*, 411*d*, and 411*e* slidably received in a sleeve 116 within a bore in the rotor 105 and pilots in the camshaft 126. One end of the spool contacts spring 115 and the opposite end of the spool contacts a pulse width modulated variable force solenoid (VFS) 107. The solenoid 107 may also be linearly controlled by varying current or voltage or other methods as applicable. Additionally, the opposite end of the spool 111 may contact and be influenced by a motor, or other actuators.

The position of the spool 411 is influenced by spring 115 and the solenoid 107 controlled by the ECU 106. Further detail regarding control of the phaser is discussed in detail below. The position of the spool 411 controls the motion (e.g. to move towards the advance position, holding position, or the retard position) of the phaser as well as whether the lock pin circuit 123 and the hydraulic default circuit 133 are open (on) or closed (off). In other words, the position of the spool 411 actively controls the piloted valve. The control valve 409 has an advance mode, a retard mode, a holding position, and a default mode.

In the advance mode, the spool 411 is moved to a position so that fluid may flow from supply S by pump 140 through inlet check valve 118, through line 119*b* to the advance chamber 102 and fluid from the retard chamber 103 exits through the spool 411 to exhaust line 121. The default valve circuit 133 is off or closed and the lock pin 125 is preferably unlocked.

In the retard mode, the spool 411 is moved to a position so that fluid may flow from supply S by pump 140 through inlet check valve 118, through line 119*b* to the retard chamber 103 and fluid from the advance chamber 102 exits through the spool 411 to exhaust line 122. The default valve circuit 133 is off and the lock pin 125 is preferably unlocked.

In holding position or null mode, the spool 411 is moved to a position that is partially open to the advance chamber 102 and the retard chamber 103 and allows supply fluid to bleed into the advance and retard chambers 102, 103, applying the same pressure to the advance chamber and retard chamber to hold the vane position. The default valve circuit 133 is off and the lock pin 125 is preferably unlocked.

When the duty cycle of the variable force solenoid 107 is 0%, the spool is in default mode, the piloted valve 130 is vented, the hydraulic default circuit 133 is open or on, and the lock pin circuit 123 is off or closed, the lock pin 125 is vented and engages with a recess 127, and the rotor 105 is locked relative to the housing assembly 100 in a mid position or an intermediate phase angle position.

Depending on where the vane 104 was prior to the duty cycle of the variable force solenoid 107 being changed to 0%, either the advance default line 128 or the retard default line 134 will be exposed to the advance or retard chamber 102, 103 respectively. In addition, if the engine had an abnormal shut down (e.g. the engine stalled), when the engine is cranking, the duty cycle of the variable force solenoid 107 would be 0%, the rotor assembly 105 would move via the default circuit 133 to a mid lock position or an intermediate phase angle position and the lock pin 125 would be engaged in mid position or intermediate phase angle position regardless of what position the vane 104 was in relative to the housing assembly 100 prior to the abnormal shut down of the engine. In the present invention, default mode is preferably when the spool is an extreme end of travel. In the examples shown in the present invention, it is when the spool is at an extreme full out position from the bore, although other positions of the spool may be used.

The ability of the phaser of the present invention to default to a mid position or intermediate phase angle position without using electronic controls allows the phaser to move to the mid position or intermediate phase angle position even during engine cranking when electronic controls are not typically used for controlling the cam phaser position. In addition, since the phaser defaults to the mid position or intermediate phase angle position, it provides a fail safe position, especially if control signals or power is lost, that guarantees that the engine will be able to start and run even without active control over the VCT phaser. Since the phaser has the mid position or intermediate phase angle position upon cranking of the engine, longer travel of the phase of the phaser is possible, providing calibration opportunities. In the prior art, longer travel phasers or a longer phase angle is not possible, since the mid position or intermediate phase angle position is not present upon engine cranking and startup and the engine has difficulty starting at either the extreme advance or retard stops.

When the duty cycle of the variable force solenoid 107 is set to 0%, the force on the VFS on the spool 411 is decreased, and the spring 115 moves the spool 411 to the far right end of the spool's travel to a default position as shown in FIG. 13. In this default position, spool land 411*b* blocks the flow of fluid from line 113 to exhaust port 121 and spool land 411*d* blocks the flow of fluid from line 112 to exhaust port 122, effectively removing control of the phaser from the control valve 409. At the same time, fluid from supply may flow through line 119 to line 119*b* and inlet check valve 118 to retard chamber 103 as shown in FIG. 13. Although, fluid may alternatively supply the advance chamber 102 instead of the retard chamber 103 as shown.

Fluid from supply flows from line 119*b* to the control valve 409 between spool lands 411*c* and 411*b* to retard line 113 leading to the retard chamber 103. Fluid is prevented from flowing directly to the advance chamber 102 from the control valve 409 and supply pump 140 by spool land 411*c*. Fluid is also prevented from flowing through line 119*a* to the lock pin 125 by spool land 411*e*. Since fluid cannot flow to line 119*a*, the lock pin 125 is no longer pressurized and vents through the spool 411 between spool land 411*d* and spool land 411*e* to exhaust line 122. Similarly, the piloted valve 130 also vents to exhaust line 122, opening passage between the advance default line 128 and the retard default line 134 through the piloted valve 130 to line 129 and the common line 114, in other words opening the hydraulic default circuit 133 and essentially converting all of the torsion assist chambers into cam torque actuated chambers (CTA) or into CTA mode with circulation of fluid being allowed between the advance chamber 102 and the retard chamber 103. Therefore, fluid supplied to the retard chamber 103 from the control valve 409 may flow into the default line 134, through the piloted valve 130 to line 129 and the common line 114, through check valve 108 through line 112 to the advance chamber 102.

If the vane 104 was positioned within the housing assembly 100 near or in the advance position and the retard default line 134 is exposed to the retard chamber 103, then fluid from the retard chamber 103 will flow into the retard default line 134 and through the open piloted valve 130 and to line 129 leading to common line 114. From the common line 114, fluid flows through check valve 108 and into the advance chamber 102, moving the vane 104 relative to the housing assembly 100 to close off the retard default line 134 to the retard chamber 103. As the rotor 105 closes off line the retard default 134 from the retard chamber 103, the vane 104 is moved to an intermediate phase angle position or a mid position within the chamber formed between the housing assembly 100 and the rotor assembly 105, and the lock pin 125 aligns with the recess 127, locking the rotor 105 relative to the housing assembly 100 in a mid position or an intermediate phase angle position.

If the vane 104 was positioned within the housing assembly 100 near or in the retard position and the advance default line 128 is exposed to the advance chamber 102, then fluid from the advance chamber 102 will flow into the advance default line 128 and through the open piloted valve 130 and to line 129 leading to common line 114. From the common line 114, fluid flows through check valve 110 and into the retard chamber 103, moving the vane 104 relative to the housing assembly 100 to close off or block advance default line 128 to the advance chamber 102. As the rotor assembly 105 closes off the advance default line 128 from the advance chamber 102, the vane 104 is moved to an intermediate phase angle position or a mid position within the chamber formed between the housing assembly 100 and the rotor assembly 105, and the lock pin 125 aligns with recess 127, locking the rotor assembly 105 relative to the housing assembly 100 in a mid position or an intermediate phase angle position.

The advance default line 128 and the retard default line 134 are completely closed off or blocked by the rotor assembly 105 from the advance and retard chambers 102, 103 when phaser is in the mid position or intermediate phase angle position, requiring that the lock pin 125 engages the recess 127 at the precise time in which the advance default line 128 or the retard default line 134 are closed off from their respective chambers. Alternatively, the advance default line 128 and the retard default line 134 may be slightly open or partially restricted to the advance and retard chambers 102, 103, in the mid position or intermediate phase angle position to allow the rotor assembly 105 to oscillate slightly, increasing the likelihood the lock pin 125 will pass over the position of the recess 127 so the lock pin 125 can engage the recess 127.

Figure 18:
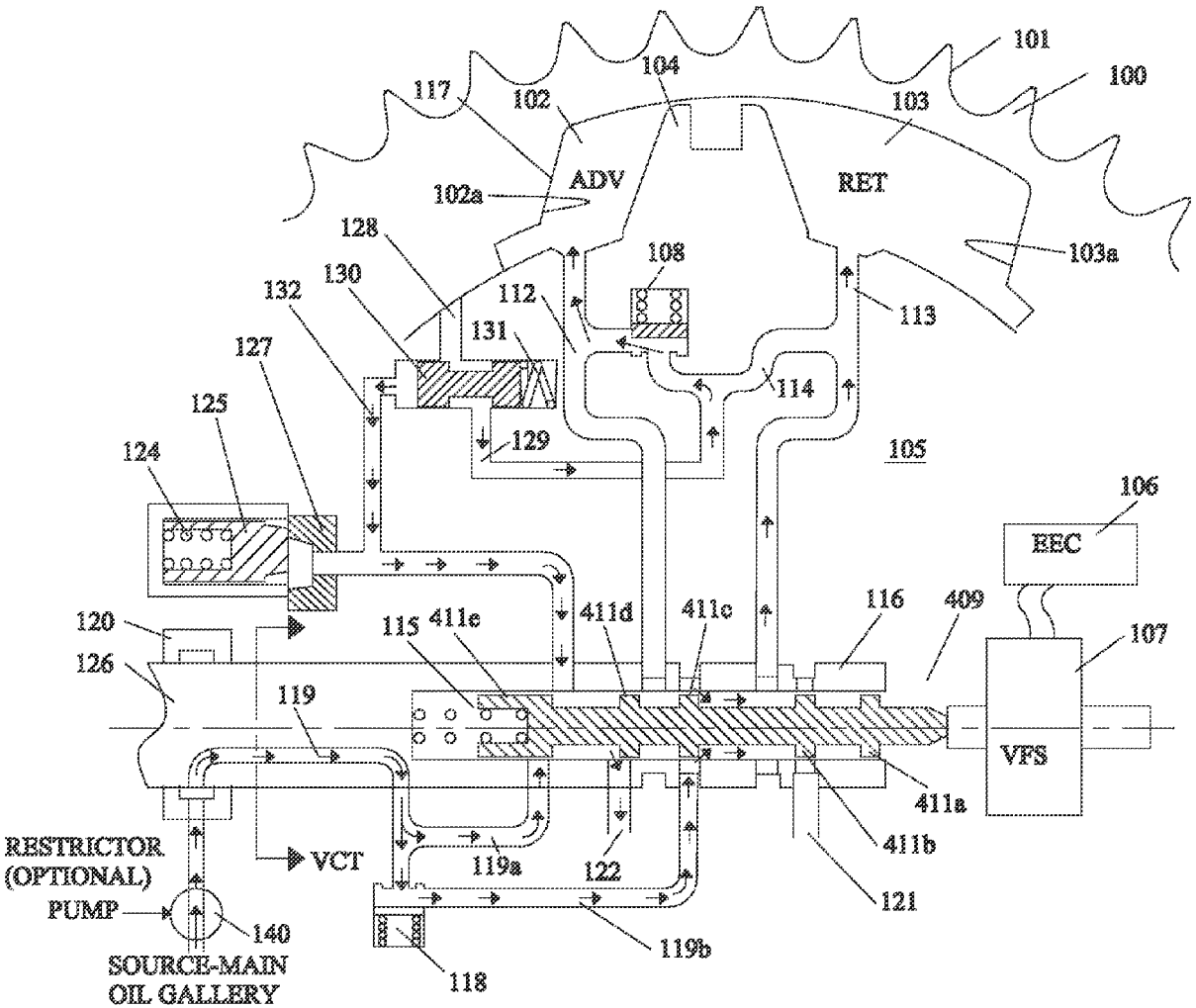
FIG. 18 shows a schematic of an alternative of the fifth embodiment of a torsion assist (TA) phaser of the present invention with a hydraulic default circuit for the advance chamber only.

Referring to FIG. 18, an alternative embodiment, the default circuit 833 is present for the advance chamber 102 only and assists in finding a mid position stop in one direction. The detent circuit 833 allows the phaser to oscillate between the mid position stop and one of the extreme stops, for example when the vane 104 is in contact with the advance wall 102*a* or the retard wall 103*a*.

The difference between the embodiment shown in FIG. 18 and the fifth embodiment of FIG. 13 is the removal of the retard default line 134 and the check valve 110 between the common line 114, line 112 and the retard chamber 103. For this embodiment, identical reference numbers as in the preceding figures apply to the same description above and are repeated herein by reference.

The hydraulic default circuit 833 includes a spring 131 loaded piloted valve 130 connected to an advance default line 128 that connects the advance chamber 102 to the piloted valve 130 and the common line 114 to check valve 108. The advance default line 128 is a predetermined distance or length from the vane 104. The piloted valve 130 is in the rotor assembly 105 and is fluidly connected to the lock pin circuit 123 and line 119*a* through line 132. The lock pin circuit 123 includes the lock pin 125, lock pin spring 124, line 132, the piloted valve 130, supply line 119*a*, and exhaust line 122.

In the default mode, the spool 411 moves to a position in which spool lands 411*d* and 411*b* blocks the flow of fluid from line 112 and line 113 from exiting the chambers 102, 103 through exhaust lines 121, 122, and only allowing a small amount of pressurized fluid from supply S to enter the retard chamber 102 and the advance chamber 102 to keep the advance and retard chambers 102, 103 full, effectively removing control of the phaser from the control valve 409.

With the default valve circuit on or open and the default valve open, one or more of the torsion assist advance and retard chambers 102, 103 are converted to cam torque actuated (CTA) mode. In other words, fluid is allowed to recirculate between the advance chamber and the retard chamber, instead of supply filling one chamber and exhausting the opposite chamber to sump through exhaust lines. The default valve circuit 833 has complete control over the phaser moving to advance or retard, until the vane 104 reaches the intermediate phase angle position.

In default mode the lock pin circuit 123 is vented, allowing the lock pin 125 to engage the recess 127. The intermediate phase angle position or mid position is when the vane 104 is somewhere between the advance wall 102*a* and the retard wall 103*a* defining the chamber between the housing assembly 100 and the rotor assembly 105. The intermediate phase angle position can be anywhere between the advance wall 102*a* and retard wall 103*a* and is determined by where the advance default passage 128 is relative to the vane 104.

Depending on where the vane 104 was prior to the duty cycle of the variable force solenoid 107 being changed to 0%, fluid from the retard chamber 103 will exit through line 113 and flows into common line 114, through check valve 108 to the advance chamber 102 through line 112. As the advance chamber 102 fills, the advance default line 128 is exposed and fluid in the advance chamber 102 recirculates back to the advance chamber 102 or retard chamber 103 depending on the direction of cam torque through the piloted valve 130. Therefore, in the advance direction, the phaser can freely move until the vane 104 contacts the retard wall 103*a*. In the retard direction, when the hydraulic detent circuit is open, the phaser moves until the advance default line 128 is closed off by the housing 100. The advance default line 128 is closed off or blocked by the rotor assembly 105 from the advance chamber 102 when phaser is in the mid position or intermediate phase angle position, requiring that the lock pin 125 engages the recess 127 at the precise time in which the advance default line 128 is closed off from its respective chambers. If the lock pin 125 doesn't engage the recess 127, the rotor 105 and vane 104 oscillates between a detent position where the advance default line 128 is blocked by the housing 100 and full advance stop, (e.g. on the side with the shortest amount of travel between the mid position locking of the lock pin) where vane 104 contacts the retard wall 103*a*. When the phaser is oscillating, the lock pin 125 will eventually mate with the recess 127, locking the phaser in the mid position.

One of the advantages of only having a default line on one side of the phaser is decreased costs, since only one check valve is needed, not two and less drilling of the phaser is required.

It is preferable to have the check valve and default line on the side of the phaser with the longest travel for the lock pin to engage the recess and not have the check valve and default line with the shortest amount of travel for the lock pin to engage the recess, therefore limiting the amount of oscillation to the side, e.g. between the intermediate phase angle or mid position stop and the extreme stop and therefore the increased oscillation that does occur is on one end of the vane travel.

Alternatively, the check valve and default line on the opposite side, for example check valve 108 and advance default line 128 may also be removed.

In the embodiments shown the control valve in the rotor, it is understood that a person skilled in the art could use a remote control valve as well.

In all of the embodiments, the default mode of the control valve is when the control valve is at an extreme end of travel. The extreme end of travel is preferably when the spool is biased full out from the bore by the spring.

While all embodiments are shown with an inlet check valve, and therefore a torsion assist phaser, a person skilled in the art would be able to apply all of the above embodiments to an oil pressure actuated phaser in which the inlet check valve 118 is removed.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A variable cam timing phaser for an internal combustion engine including a housing assembly with an outer circumference for accepting drive force and a rotor assembly coaxially located within the housing for connection to a camshaft, having a plurality of vanes, wherein the housing assembly and the rotor assembly define at least one chamber separated by a vane into an advance chamber and a retard chamber, the vane within the chamber acting to shift relative angular position of the housing assembly and the rotor assembly when fluid is supplied to the advance chamber or the retard chamber, the phaser comprising:

a control valve for directing fluid from a fluid input to and from the advance chamber and the retard chamber through an advance line, a retard line, a supply line coupled to the fluid input, and at least one exhaust line, and the control valve being movable between a default mode and an oil pressure actuated mode comprising: an advance mode in which fluid is routed from the fluid input to the advance chamber and fluid is routed from the retard chamber to the exhaust lines, a retard mode in which fluid is routed from the fluid input to the retard chamber and fluid is routed from the advance chamber to the exhaust lines, a holding position in which fluid is routed to the advance chamber and the retard chamber;

wherein when the control valve is in the default mode, the control valve blocks the at least one exhaust line, retaining fluid within the advance chamber and retard chamber.

2. The phaser of claim 1, wherein when the control valve is in default mode fluid flow from the supply line to the advance chamber and the retard chamber is restricted.

3. The phaser of claim 1, wherein the when the control valve is in the default mode, fluid flows to either the advance chamber or the retard chamber and is blocked from flowing through the control valve to the other advance chamber or other retard chamber.

4. The phaser of claim 1, further comprising a default circuit that is switchable from an open position to a closed position, wherein when the default circuit is in the open position, the default circuit moves the vane to an intermediate position within the at least one chamber defined by the housing assembly and the rotor assembly.

5. The phaser of claim 4, wherein when the default circuit is in a closed position, the control valve is moved to the oil pressure actuated mode and fluid flows through the control valve to oil pressure actuates the advance and retard chambers.

6. The phaser of claim 4, wherein when the default circuit is open, fluid is allowed to flow between an advance default line to at least one advance chamber and a retard default line to at least one retard chamber and a common line in fluid communication with the advance chamber and the retard chamber with advance and retard check valves, such that the rotor assembly is moved through cam torque actuation of one advance chamber and one retard chamber to and held in an intermediate phase angle position relative to the housing assembly.

7. The phaser of claim 4, wherein when the default circuit is open, fluid is allowed to flow between either the advance chamber or the retard chamber through an advance default line or a retard default line to the other advance chamber or retard chamber and the advance chamber or retard chamber to the other advance chamber and retard chamber through a common line, such that default circuit restricts motion of the rotor assembly towards the intermediate position in one direction only.

8. The phaser of claim 4, wherein the default circuit is switchable between the open position and the closed position through a piloted valve.

9. The phaser of claim 1, wherein the fluid input to the phaser further comprises an inlet check valve.

10. The phaser of claim 1, further comprising:

a lock pin slidably located in the rotor assembly or the housing assembly, the lock pin being moveable by fluid in the supply line from a locked position in which an end portion engages a recess, locking the relative angular position of the housing assembly and the rotor assembly, to an unlocked position, in which the end portion does not engage the recess; and wherein when the control valve is moved to the default mode, the lock pin is moved to the locked position;

wherein when the control valve is moved towards the advance mode, or the retard mode, or in the holding position, the lock pin is moved to the unlocked position.

11. The phaser of claim 1, wherein when the control valve is in the default mode, fluid flow from the supply line to the advance chamber and the retard chamber is unrestricted.

12. The phaser of claim 11, further comprising a default circuit that is switchable from an open position to a closed position, wherein when the default circuit is in the open position, the default circuit moves the vane to a intermediate position within the at least one chamber defined by the housing assembly and the rotor assembly.

13. The phaser of claim 12, wherein when the default circuit is in the open position, one or more advance chambers and retard chambers are isolated functionally and fluid in the supply line flows to remaining advance and retard chambers unrestricted, such that fluid flow is allowed to recirculate between the remaining advance and retard chambers, removing influence of the vane within the remaining advance and retard chambers, and converting the isolated functionally advance and retard chambers from oil pressure actuation to cam torque actuation by allowing fluid in the supply line to flow between an advance default line to one advance chamber and a retard default line to the isolated functionally advance chamber and retard chamber and a common line in fluid communication with the isolated functionally advance chamber and retard chamber and the retard chamber with advance and retard check valves; and wherein when the default circuit is in the closed position, fluid flows through the control valve to oil pressure actuate the remaining advance and retard chambers and reconnect the one or more advance chambers and retard chambers isolated functionally to the control valve and oil pressure actuation.

14. The phaser of claim 11, further comprising:

a lock pin slidably located in the rotor assembly or the housing assembly, the lock pin being moveable by fluid in the supply line from a locked position in which an end portion engages a recess, locking the relative angular position of the housing assembly and the rotor assembly, to an unlocked position, in which the end portion does not engage the recess; and wherein when the control valve is moved to the default mode, the lock pin is moved to the locked position;

wherein when the control valve is moved towards the advance mode, or the retard mode, or in the holding position, the lock pin is moved to the unlocked position.

15. A variable cam timing phaser for an internal combustion engine comprising:

a housing assembly with an outer circumference for accepting drive force;

a rotor assembly coaxially located within the housing for connection to a camshaft, having a plurality of vanes, wherein the housing assembly and the rotor assembly define at least one cam torque actuated chamber separated by a cam torque vane into a cam torque actuated advance chamber and a cam torque actuated retard chamber, such that fluid flow between the cam torque actuated advance chamber and the cam torque actuated retard chamber reacting to cam torque forces in the camshaft allows the cam torque vane to shift a relative angular position of the housing assembly with respect to the rotor assembly; and wherein the housing assembly and the rotor assembly define at least one oil pressure actuated chamber separated by an oil pressure actuated vane into an oil pressure actuated advance chamber and an oil pressure actuated retard chamber, such that fluid pressure supplied to the oil pressure actuated advance chamber or to the oil pressure actuated retard chamber moves the oil pressure vane to shift the relative angular position of the housing assembly with respect to the rotor assembly; and wherein the oil pressure actuated chambers are isolated functionally from the cam torque actuated chambers;

a control valve for directing fluid from a fluid input to and from the oil pressure actuated advance chamber and the oil pressure actuated retard chamber through an advance line, a retard line, a supply line coupled to the fluid input, exhaust lines;

the control valve being movable between a default mode and an oil pressure actuated mode comprising: advance mode in which fluid is routed from the fluid input to the oil pressure actuated advance chamber and fluid is routed from the oil pressure retard chamber to the exhaust lines, a retard mode in which fluid is routed from the fluid input to the oil pressure actuated retard chamber and fluid is routed from the oil pressure actuated advance chamber to exhaust lines, a holding position in which fluid is routed to the oil pressure actuated advance chamber and the oil pressure actuated retard chamber; and wherein when the control valve is in the default mode, the control valve blocks the at least one exhaust line, retaining fluid within the oil pressure actuated advance chamber and oil pressure actuated retard chamber and supplies unrestricted oil flow to the oil pressure actuated advance chamber and the oil pressure actuated retard chamber;

a default circuit that is switchable from an open position to a closed position;

wherein when the default circuit is in the open position, fluid is allowed to flow between an advance default line to the cam torque actuated advance chamber and a retard default line to the cam torque actuated retard chamber and a common line in fluid communication with the cam torque actuated advance chamber and the retard chamber with advance and retard check valves, such that the rotor assembly is moved through cam torque actuation of the advance chamber and the retard chamber to and held in an intermediate phase angle position relative to the housing assembly;

wherein when the default circuit is closed, fluid flows unrestricted between the cam torque actuated advance chamber and the cam torque actuated retard chamber.

16. The phaser of claim 15, wherein the default circuit is switchable between the open position and the closed position through a piloted valve.

17. The phaser of claim 15, a lock pin slidably located in the rotor assembly or the housing assembly, the lock pin being moveable by fluid in the supply line from a locked position in which an end portion engages a recess, locking the relative angular position of the housing assembly and the rotor assembly, to an unlocked position, in which the end portion does not engage the recess;

wherein when the control valve is moved to the default mode, the lock pin is moved to the locked position;

wherein when the control valve is moved towards the advance mode, or the retard mode, or in the holding position, the lock pin is moved to the unlocked position.

18. The phaser of claim 15, wherein the fluid input to the phaser further comprises an inlet check valve.

19. A variable cam timing phaser for an internal combustion engine comprising:

a housing assembly with an outer circumference for accepting drive force;

a rotor assembly coaxially located within the housing for connection to a camshaft, having a plurality of vanes, wherein the housing assembly and the rotor assembly define at least one cam torque actuated chamber separated by a cam torque vane into a cam torque actuated advance chamber and a cam torque actuated retard chamber, such that fluid flow between the cam torque actuated advance chamber and the cam torque actuated retard chamber reacting to cam torque forces in the camshaft allows the cam torque vane to shift a relative angular position of the housing assembly with respect to the rotor assembly; and wherein the housing assembly and the rotor assembly define at least one oil pressure actuated chamber separated by an oil pressure actuated vane into an oil pressure actuated advance chamber and an oil pressure actuated retard chamber, such that fluid pressure supplied to the oil pressure actuated advance chamber or to the oil pressure actuated retard chamber moves the oil pressure vane to shift the relative angular position of the housing assembly with respect to the rotor assembly; and wherein the oil pressure actuated chambers are isolated functionally from the cam torque actuated chambers;

a control valve for directing fluid from a fluid input to and from the oil pressure actuated advance chamber and the oil pressure actuated retard chamber through an advance line, a retard line, a supply line coupled to the fluid input, exhaust lines;

the control valve being movable between a default mode and an oil pressure actuated mode comprising: advance mode in which fluid is routed from the fluid input to the oil pressure actuated advance chamber and fluid is routed from the oil pressure retard chamber to the exhaust lines, a retard mode in which fluid is routed from the fluid input to the oil pressure actuated retard chamber and fluid is routed from the oil pressure actuated advance chamber to exhaust lines, a holding position in which fluid is routed to the oil pressure actuated advance chamber and the oil pressure actuated retard chamber;

wherein when the control valve is in the default mode, exhausts the oil pressure actuated advance chamber and the oil pressure actuated retard chamber through exhaust lines and the control valve blocks fluid from the supply line to the oil pressure actuated advance chamber and oil pressure actuated retard chamber;

a default circuit that is switchable from an open position to a closed position;

wherein when the default circuit is in the open position, fluid is allowed to flow between an advance default line to the cam torque actuated advance chamber and a retard default line to the cam torque actuated retard chamber and a common line in fluid communication with the cam torque actuated advance chamber and the retard chamber with advance and retard check valves, such that the rotor assembly is moved through cam torque actuation of the advance chamber and the retard chamber to and held in an intermediate phase angle position relative to the housing assembly;

wherein when the default circuit is closed, fluid flows unrestricted between the cam torque actuated advance chamber and the cam torque actuated retard chamber.

20. The phaser of claim 19, wherein the default circuit is switchable between the open position and the closed position through a piloted valve.

21. The phaser of claim 19, a lock pin slidably located in the rotor assembly or the housing assembly, the lock pin being moveable by fluid in the supply line from a locked position in which an end portion engages a recess, locking the relative angular position of the housing assembly and the rotor assembly, to an unlocked position, in which the end portion does not engage the recess;

wherein when the control valve is moved to the default mode, the lock pin is moved to the locked position;

wherein when the control valve is moved towards the advance mode, or the retard mode, or in the holding position, the lock pin is moved to the unlocked position.

22. The phaser of claim 19, wherein the fluid input to the phaser further comprises an inlet check valve.

* * * * *